US007264067B2

(12) United States Patent
Glaser et al.

(10) Patent No.: US 7,264,067 B2
(45) Date of Patent: Sep. 4, 2007

(54) METHOD OF DRILLING AND COMPLETING MULTIPLE WELLBORES INSIDE A SINGLE CAISSON

(75) Inventors: Mark C. Glaser, Houston, TX (US); Jack R. Allen, Porter, TX (US); Gerald M. Ferguson, Houston, TX (US); Ralph A. Alvarez, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 243 days.

(21) Appl. No.: 10/956,742

(22) Filed: Oct. 1, 2004

(65) Prior Publication Data

US 2005/0194188 A1 Sep. 8, 2005

Related U.S. Application Data

(60) Provisional application No. 60/508,743, filed on Oct. 3, 2003.

(51) Int. Cl.
*E21B 7/04* (2006.01)

(52) U.S. Cl. ..... 175/61; 166/313; 166/52

(58) Field of Classification Search ..... 166/313, 166/52; 175/61, 73
See application file for complete search history.

(56) References Cited

U.S. PATENT DOCUMENTS

| | | | |
|---|---|---|---|
| 122,514 | A | 1/1872 | Bullock |
| 761,518 | A | 5/1904 | Lykken |
| 1,077,772 | A | 11/1913 | Weathersby |
| 1,185,582 | A | 5/1916 | Bignell |
| 1,301,285 | A | 4/1919 | Leonard |
| 1,324,303 | A | 12/1919 | Carmichael |
| 1,342,424 | A | 6/1920 | Cotten |
| 1,418,766 | A | 6/1922 | Wilson |
| 1,459,990 | A | 6/1923 | Reed |
| 1,471,526 | A | 10/1923 | Pickin |
| 1,545,039 | A | 7/1925 | Deavers |
| 1,561,418 | A | 11/1925 | Duda |
| 1,569,729 | A | 1/1926 | Duda |
| 1,585,069 | A | 5/1926 | Youle |
| 1,597,212 | A | 8/1926 | Spengler |

(Continued)

FOREIGN PATENT DOCUMENTS

| | | |
|---|---|---|
| CA | 2 335 192 | 11/2001 |

(Continued)

OTHER PUBLICATIONS

Multilateral Case History, Onshore Nigeria, Baker Hughes, 2002.

(Continued)

*Primary Examiner*—William Neuder
(74) *Attorney, Agent, or Firm*—Patterson & Sheridan, LLP

(57) ABSTRACT

A method and apparatus for drilling and completing multiple wellbores from a single drilling rig and from within a single wellhead is provided. In one embodiment, a template is disposed at a predetermined location downhole within a casing. In one aspect, a first casing string is lowered with the template to the predetermined location and disposed within a first wellbore. A second wellbore may be drilled through a bore in the template. A second casing string may then be lowered through the bore into the second wellbore. In another embodiment, at least two wellbores are drilled and completed from a surface casing having a crossover portion.

52 Claims, 23 Drawing Sheets

U.S. PATENT DOCUMENTS

| | | | |
|---|---|---|---|
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |
| 1,851,289 | A | 3/1932 | Owen |
| 1,880,218 | A | 10/1932 | Simmons |
| 1,917,135 | A | 7/1933 | Littell |
| 1,930,825 | A | 10/1933 | Raymond |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,102,555 | A | 12/1937 | Dyer |
| 2,105,885 | A | 1/1938 | Hinderliter |
| 2,167,338 | A | 7/1939 | Murcell |
| 2,214,226 | A | 9/1940 | English |
| 2,214,429 | A | 9/1940 | Miller |
| 2,216,226 | A | 10/1940 | Bumpous |
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church et al. |
| 2,324,679 | A | 7/1943 | Cox |
| 2,344,120 | A | 3/1944 | Baker |
| 2,345,308 | A | 3/1944 | Wallace |
| 2,370,832 | A | 3/1945 | Baker |
| 2,379,800 | A | 7/1945 | Hare |
| 2,383,214 | A | 8/1945 | Prout |
| 2,414,719 | A | 1/1947 | Cloud |
| 2,499,630 | A | 3/1950 | Clark |
| 2,522,444 | A | 9/1950 | Grable |
| 2,536,458 | A | 1/1951 | Munsinger |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bieber et al. |
| 2,668,689 | A | 2/1954 | Cormany |
| 2,692,059 | A | 10/1954 | Bolling, Jr. |
| 2,696,367 | A | 12/1954 | Robishaw |
| 2,720,267 | A | 10/1955 | Brown |
| 2,738,011 | A | 3/1956 | Mabry |
| 2,741,907 | A | 4/1956 | Genender et al. |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,898,971 | A | 8/1959 | Hempel |
| 2,953,406 | A | 9/1960 | Young |
| 2,978,047 | A | 4/1961 | DeVaan |
| 3,001,585 | A | 9/1961 | Shiplet |
| 3,006,415 | A | 10/1961 | Burns et al. |
| 3,041,901 | A | 7/1962 | Knights |
| 3,054,100 | A | 9/1962 | Jones |
| 3,087,546 | A | 4/1963 | Wooley |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,193,116 | A | 7/1965 | Kenneday et al. |
| 3,195,646 | A | 7/1965 | Brown |
| 3,273,660 | A | 9/1966 | Jackson et al. |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,467,180 | A | 9/1969 | Pensotti |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,848 | A | 1/1971 | Van Wagner |
| 3,559,739 | A | 2/1971 | Hutchison |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Weiner |
| 3,621,910 | A | 11/1971 | Sanford |
| 3,624,760 | A | 11/1971 | Bodine |
| 3,635,105 | A | 1/1972 | Dickmann et al. |
| 3,656,564 | A | 4/1972 | Brown |
| 3,662,842 | A | 5/1972 | Bromell |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,700,048 | A | 10/1972 | Desmoulins |
| 3,712,376 | A | 1/1973 | Owen et al. |
| 3,729,057 | A | 4/1973 | Wemer |
| 3,746,330 | A | 7/1973 | Taciuk |
| 3,747,675 | A | 7/1973 | Brown |
| 3,760,894 | A | 9/1973 | Pitifer |
| 3,766,991 | A | 10/1973 | Brown |
| 3,776,307 | A | 12/1973 | Young |
| 3,776,320 | A | 12/1973 | Brown |
| 3,785,193 | A | 1/1974 | Kinley et al. |
| 3,808,916 | A | 5/1974 | Porter et al. |
| 3,818,734 | A | 6/1974 | Bateman |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,870,114 | A | 3/1975 | Pulk et al. |
| 3,881,375 | A | 5/1975 | Kelly |
| 3,885,679 | A | 5/1975 | Swoboda, Jr. et al. |
| 3,901,331 | A | 8/1975 | Djurovic |
| 3,911,707 | A | 10/1975 | Minakov et al. |
| 3,913,687 | A | 10/1975 | Gyongyosi et al. |
| 3,915,244 | A | 10/1975 | Brown |
| 3,934,660 | A | 1/1976 | Nelson |
| 3,935,910 | A | 2/1976 | Gaudy et al. |
| 3,945,444 | A | 3/1976 | Knudson |
| 3,947,009 | A | 3/1976 | Nelmark |
| 3,948,321 | A | 4/1976 | Owen et al. |
| 3,964,556 | A | 6/1976 | Gearhart et al. |
| 3,980,143 | A | 9/1976 | Swartz et al. |
| 4,049,066 | A | 9/1977 | Richey |
| 4,054,332 | A | 10/1977 | Bryan, Jr. |
| 4,054,426 | A | 10/1977 | White |
| 4,064,939 | A | 12/1977 | Marquis |

4,069,573 A 1/1978 Rogers, Jr. et al.
4,077,525 A 3/1978 Callegari et al.
4,082,144 A 4/1978 Marquis
4,083,405 A 4/1978 Shirley
4,085,808 A 4/1978 Kling
4,095,865 A 6/1978 Denison et al.
4,100,968 A 7/1978 Delano
4,100,981 A 7/1978 Chaffin
4,127,168 A 11/1978 Hanson et al.
4,127,927 A 12/1978 Hauk et al.
4,133,396 A 1/1979 Tschirky
4,142,739 A 3/1979 Billingsley
4,159,564 A 7/1979 Cooper, Jr.
4,173,457 A 11/1979 Smith
4,175,619 A 11/1979 Davis
4,182,423 A 1/1980 Ziebarth et al.
4,186,628 A 2/1980 Bonnice
4,189,185 A 2/1980 Kammerer, Jr. et al.
4,194,383 A 3/1980 Huzyak
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,288,082 A 9/1981 Setterberg, Jr.
4,311,195 A 1/1982 Mullins, II
4,315,553 A 2/1982 Stallings
4,319,393 A 3/1982 Pogonowski
4,320,915 A 3/1982 Abbott et al.
4,324,407 A 4/1982 Upham et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,429,620 A 2/1984 Burkhardt et al.
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,469,174 A 9/1984 Freeman
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,531,581 A 7/1985 Pringle et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,588,030 A 5/1986 Blizzard
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,610,320 A 9/1986 Beakley
4,613,161 A 9/1986 Brisco
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,697,640 A 10/1987 Szarka
4,699,224 A 10/1987 Burton
4,708,202 A 11/1987 Sukup et al.
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,770,259 A 9/1988 Jansson
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,858,705 A 8/1989 Thiery
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse 4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,024,273 A 6/1991 Coone et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,083,608 A 1/1992 Abdrakhmanov et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky et al.
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,303,772 A 4/1994 George et al.
5,305,830 A 4/1994 Wittrisch
5,305,839 A 4/1994 Kalsi et al.
5,311,952 A 5/1994 Eddison et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,343,968 A 9/1994 Glowka
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,409,059 A 4/1995 McHardy
5,433,279 A 7/1995 Tessari et al.
5,435,386 A 7/1995 LaFleur
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,462,120 A 10/1995 Gondouin
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,426 A 10/1996 Trahan et al.
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,611,397 A 3/1997 Wood
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,685,369 A 11/1997 Ellis et al.
5,685,373 A 11/1997 Collins et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,718,288 A 2/1998 Bertet et al.
5,720,356 A 2/1998 Gardes
5,730,221 A 3/1998 Longbottom et al.
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,755,299 A 5/1998 Langford, Jr. et al.

5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,791,416 A 8/1998 White et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,829,539 A 11/1998 Newton et al.
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A * 3/1999 Collins ..... 166/313
5,887,655 A 3/1999 Haugen et al.
5,887,668 A 3/1999 Haugen et al.
5,890,537 A 4/1999 Lavaure et al.
5,890,540 A 4/1999 Pia et al.
5,890,549 A 4/1999 Sprehe
5,894,897 A 4/1999 Vail, III
5,901,787 A 5/1999 Boyle
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,021,850 A 2/2000 Wood et al.
6,024,169 A 2/2000 Haugen
6,026,911 A 2/2000 Angle et al.
6,029,748 A 2/2000 Forsyth et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,085,838 A 7/2000 Vercaemer et al.
6,089,323 A 7/2000 Newman et al.
6,098,717 A 8/2000 Bailey et al.
6,106,200 A 8/2000 Mocivnik et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,224,112 B1 5/2001 Eriksen et al.
6,227,587 B1 5/2001 Terral
6,234,257 B1 5/2001 Ciglenec et al.
6,237,684 B1 5/2001 Bouligny, Jr. et al.
6,244,363 B1 6/2001 McLeod
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 5/2002 Mullins
6,392,317 B1 5/2002 Hall et al.
6,397,946 B1 6/2002 Vail, III
6,401,820 B1 6/2002 Kirk et al.
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,425,444 B1 7/2002 Metcalfe et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,323 B1 9/2002 Metcalfe et al.
6,446,723 B1 9/2002 Ramons et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.

6,497,280 B2 12/2002 Beck et al.
6,497,289 B1 12/2002 Cook et al.
6,527,047 B1 3/2003 Pietras
6,527,049 B2 3/2003 Metcalfe et al.
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Metcalfe et al.
6,547,017 B1 4/2003 Vail, III
6,553,825 B1 4/2003 Boyd
6,554,063 B2 * 4/2003 Ohmer ..... 166/50
6,554,064 B1 4/2003 Restarick et al.
6,571,868 B2 6/2003 Victor
6,578,630 B2 6/2003 Simpson et al.
6,585,040 B2 7/2003 Hanton et al.
6,591,471 B1 7/2003 Hollingsworth et al.
6,591,905 B2 7/2003 Coon
6,595,288 B2 7/2003 Mosing et al.
6,612,383 B2 9/2003 Desai et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,640,903 B1 11/2003 Cook et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,029 B2 3/2004 Metcalfe et al.
6,702,040 B1 3/2004 Sensenig
6,705,413 B1 3/2004 Tessari
6,708,769 B2 3/2004 Haugen et al.
6,715,430 B2 4/2004 Choi et al.
6,719,071 B1 4/2004 Moyes
6,722,559 B1 4/2004 Millar et al.
6,725,917 B2 4/2004 Metcalfe
6,725,919 B2 4/2004 Cook et al.
6,725,924 B2 4/2004 Davidson et al.
6,725,938 B1 4/2004 Pietras
6,732,822 B2 5/2004 Slack et al.
6,742,584 B1 6/2004 Appleton
6,742,591 B2 6/2004 Metcalfe
6,742,596 B2 6/2004 Haugen
6,742,606 B2 6/2004 Metcalfe et al.
6,745,834 B2 6/2004 Davis et al.
6,749,026 B2 6/2004 Smith et al.
6,752,211 B2 6/2004 Dewey et al.
6,758,278 B2 7/2004 Cook et al.
6,776,233 B2 8/2004 Meehan
6,802,374 B2 10/2004 Edgar et al.
6,832,656 B2 12/2004 Fournier, Jr. et al.
6,832,658 B2 12/2004 Keast
6,837,313 B2 1/2005 Hosie et al.
6,840,322 B2 1/2005 Haynes
6,845,820 B1 1/2005 Hebert et al.
6,848,517 B2 2/2005 Wardley
6,854,533 B2 2/2005 Galloway
6,857,486 B2 2/2005 Chitwood et al.
6,857,487 B2 2/2005 Galloway
6,868,906 B1 3/2005 Vail, III et al.
6,877,553 B2 4/2005 Cameron
6,892,819 B2 5/2005 Cook et al.
6,892,835 B2 5/2005 Shahin et al.
6,896,075 B2 5/2005 Haugen et al.
6,899,186 B2 5/2005 Galloway et al.
6,899,772 B1 5/2005 Buytaert et al.
6,920,932 B2 7/2005 Zimmerman
6,923,255 B2 8/2005 Lee
6,926,126 B2 8/2005 Baumann et al.
6,941,652 B2 9/2005 Echols et al.
6,953,096 B2 10/2005 Gledhill et al.
7,004,264 B2 2/2006 Simpson et al.
7,013,992 B2 3/2006 Tessari et al.
7,013,997 B2 3/2006 Vail, III
7,036,610 B1 5/2006 Vail, III
7,040,420 B2 5/2006 Vail, III
7,044,241 B2 5/2006 Angman
7,048,050 B2 5/2006 Vail, III et al.
7,082,997 B2 8/2006 Slack
7,090,004 B2 8/2006 Warren et al.
7,093,675 B2 8/2006 Pia
7,096,982 B2 8/2006 McKay et al.
7,100,710 B2 9/2006 Vail, III
7,100,713 B2 9/2006 Tulloch
7,108,072 B2 9/2006 Cook et al.
7,108,080 B2 9/2006 Tessari et al.
7,108,083 B2 9/2006 Simonds et al.
7,108,084 B2 9/2006 Vail, III
7,117,957 B2 10/2006 Metcalfe et al.
7,124,825 B2 10/2006 Slack
7,128,154 B2 10/2006 Giroux et al.
7,137,454 B2 11/2006 Pietras
7,140,443 B2 11/2006 Beierbach et al.
7,140,455 B2 11/2006 Walter et al.
7,143,847 B2 12/2006 Pia
7,147,068 B2 12/2006 Vail, III
7,159,668 B2 1/2007 Herrera
7,165,634 B2 1/2007 Vail, III
2001/0000101 A1 4/2001 Lovato et al.
2001/0040054 A1 11/2001 Haugen et al.
2001/0042625 A1 11/2001 Appleton
2001/0045284 A1 11/2001 Simpson et al.
2002/0040787 A1 4/2002 Cook et al.
2002/0066556 A1 6/2002 Goode et al.
2002/0108748 A1 8/2002 Keyes
2002/0145281 A1 10/2002 Metcalfe et al.
2002/0166668 A1 11/2002 Metcalfe et al.
2002/0170720 A1 11/2002 Haugen
2002/0189863 A1 12/2002 Wardley
2003/0029641 A1 2/2003 Meehan
2003/0042022 A1 3/2003 Lauritzen et al.
2003/0056991 A1 3/2003 Hahn et al.
2003/0070841 A1 4/2003 Merecka et al.
2003/0111267 A1 6/2003 Pia
2003/0141111 A1 7/2003 Pia
2003/0146023 A1 8/2003 Pia
2003/0164251 A1 9/2003 Tulloch
2003/0164276 A1 9/2003 Snider et al.
2003/0173073 A1 9/2003 Snider et al.
2003/0173090 A1 9/2003 Cook et al.
2003/0183424 A1 10/2003 Tulloch
2003/0217865 A1 11/2003 Simpson et al.
2003/0221519 A1 12/2003 Haugen et al.
2004/0003490 A1 1/2004 Shahin et al.
2004/0003944 A1 1/2004 Vincent et al.
2004/0011534 A1 1/2004 Simonds et al.
2004/0011566 A1 1/2004 Lee
2004/0060697 A1 4/2004 Tilton et al.
2004/0060700 A1 4/2004 Vert et al.
2004/0069500 A1 4/2004 Haugen
2004/0108142 A1 6/2004 Vail, III
2004/0112603 A1 6/2004 Galloway et al.
2004/0112646 A1 6/2004 Vail
2004/0112693 A1 6/2004 Baumann et al.
2004/0118613 A1 6/2004 Vail

| | | | | |
|---|---|---|---|---|
| 2004/0118614 | A1 | 6/2004 | Galloway et al. | |
| 2004/0123984 | A1 | 7/2004 | Vail | |
| 2004/0124010 | A1 | 7/2004 | Galloway et al. | |
| 2004/0124011 | A1 | 7/2004 | Gledhill et al. | |
| 2004/0124015 | A1 | 7/2004 | Vaile et al. | |
| 2004/0129456 | A1 | 7/2004 | Vail | |
| 2004/0140128 | A1 | 7/2004 | Vail | |
| 2004/0144547 | A1 | 7/2004 | Koithan et al. | |
| 2004/0173358 | A1 | 9/2004 | Haugen | |
| 2004/0182579 | A1* | 9/2004 | Steele et al. | 166/313 |
| 2004/0216892 | A1 | 11/2004 | Giroux et al. | |
| 2004/0216924 | A1 | 11/2004 | Pietras et al. | |
| 2004/0216925 | A1 | 11/2004 | Metcalfe et al. | |
| 2004/0221997 | A1 | 11/2004 | Giroux et al. | |
| 2004/0226751 | A1 | 11/2004 | McKay et al. | |
| 2004/0238218 | A1 | 12/2004 | Runia et al. | |
| 2004/0244992 | A1 | 12/2004 | Carter et al. | |
| 2004/0245020 | A1 | 12/2004 | Giroux et al. | |
| 2004/0251025 | A1 | 12/2004 | Giroux et al. | |
| 2004/0251050 | A1 | 12/2004 | Shahin et al. | |
| 2004/0251055 | A1 | 12/2004 | Shahin et al. | |
| 2004/0262013 | A1 | 12/2004 | Tilton et al. | |
| 2005/0000691 | A1 | 1/2005 | Giroux et al. | |
| 2005/0011643 | A1 | 1/2005 | Slack et al. | |
| 2005/0077048 | A1* | 4/2005 | Hall | 166/342 |
| 2005/0096846 | A1 | 5/2005 | Koithan et al. | |
| 2005/0152749 | A1 | 7/2005 | Anres et al. | |
| 2005/0183892 | A1 | 8/2005 | Oldham et al. | |

FOREIGN PATENT DOCUMENTS

| | | |
|---|---|---|
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 397 323 | 11/1990 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 733596 | 7/1955 |
| GB | 7 928 86 | 4/1958 |
| GB | 8 388 33 | 6/1960 |
| GB | 881 358 | 11/1961 |
| GB | 887150 | 1/1962 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 221 482 | 7/1990 |
| GB | 2 224 481 | 9/1990 |
| GB | 2 239 918 | 7/1991 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 320 734 | 7/1998 |
| GB | 2 324 108 | 10/1998 |
| GB | 2 326 896 | 1/1999 |
| GB | 2 333 542 | 7/1999 |
| GB | 2 335 217 | 9/1999 |
| GB | 2 345 074 | 6/2000 |
| GB | 2 347 445 | 9/2000 |
| GB | 2 348 223 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 381 809 | 5/2003 |
| GB | 2 382 361 | 5/2003 |
| GB | 2 386 626 | 9/2003 |
| GB | 2388389 | 11/2003 |
| GB | 2 389 130 | 12/2003 |
| GB | 2 396 375 | 6/2004 |
| RU | 1808972 | 4/1993 |
| RU | 955765 | 1/1995 |
| RU | 1304470 | 1/1995 |
| RU | 2 079 633 | 5/1997 |
| RU | 2079633 | 5/1997 |
| SU | 112631 | 1/1956 |
| SU | 247162 | 5/1967 |
| SU | 395557 | 8/1973 |
| SU | 415346 | 2/1974 |
| SU | 461218 | 2/1975 |
| SU | 481689 | 8/1975 |
| SU | 501139 | 1/1976 |
| SU | 581238 | 11/1977 |
| SU | 583278 | 12/1977 |
| SU | 585266 | 12/1977 |
| SU | 601390 | 4/1978 |
| SU | 655843 | 4/1979 |
| SU | 781312 | 11/1980 |
| SU | 899820 | 1/1982 |
| SU | 1 618 870 | 1/1991 |
| WO | WO82/01211 | 4/1982 |
| WO | WO90-06418 | 6/1990 |
| WO | WO91-16520 | 10/1991 |
| WO | WO92-01139 | 1/1992 |
| WO | WO92-18743 | 10/1992 |
| WO | WO92-20899 | 11/1992 |
| WO | WO93-07358 | 4/1993 |
| WO | WO93-24728 | 12/1993 |
| WO | WO95-10686 | 4/1995 |
| WO | WO96-18799 | 6/1996 |
| WO | WO96-28635 | 9/1996 |
| WO | WO97-05360 | 2/1997 |
| WO | WO97/05360 | 2/1997 |
| WO | WO97-08418 | 3/1997 |

| | | |
|---|---|---|
| WO | WO98/01651 | 1/1998 |
| WO | WO98-05844 | 2/1998 |
| WO | WO98-09053 | 3/1998 |
| WO | WO98-11322 | 3/1998 |
| WO | WO98-32948 | 7/1998 |
| WO | WO98-55730 | 12/1998 |
| WO | WO99/04135 | 1/1999 |
| WO | WO99-04135 | 1/1999 |
| WO | WO99-11902 | 3/1999 |
| WO | WO99/18328 | 4/1999 |
| WO | WO99-23354 | 5/1999 |
| WO | WO99-24689 | 5/1999 |
| WO | WO99/24689 | 5/1999 |
| WO | WO99-35368 | 7/1999 |
| WO | WO99-37881 | 7/1999 |
| WO | WO99-41485 | 8/1999 |
| WO | WO99-50528 | 10/1999 |
| WO | WO99-58810 | 11/1999 |
| WO | WO99-64713 | 12/1999 |
| WO | WO 00/04269 | 1/2000 |
| WO | WO 00-05483 | 2/2000 |
| WO | WO 00-08293 | 2/2000 |
| WO | WO 00/09853 | 2/2000 |
| WO | WO 00-11309 | 3/2000 |
| WO | WO 00-11310 | 3/2000 |
| WO | WO 00-11311 | 3/2000 |
| WO | WO 00-28188 | 5/2000 |
| WO | WO 00-37766 | 6/2000 |
| WO | WO 00-37771 | 6/2000 |
| WO | WO 00/37772 | 6/2000 |
| WO | WO 00/37773 | 6/2000 |
| WO | WO 00-39429 | 7/2000 |
| WO | WO 00-39430 | 7/2000 |
| WO | WO 00/41487 | 7/2000 |
| WO | WO 00-46484 | 8/2000 |
| WO | WO 00-50730 | 8/2000 |
| WO | WO 00/50730 | 8/2000 |
| WO | WO 00/50732 | 8/2000 |
| WO | WO 00-66879 | 11/2000 |
| WO | WO 00/77431 | 12/2000 |
| WO | WO 01-12946 | 2/2001 |
| WO | WO 01-46550 | 6/2001 |
| WO | WO 01/60545 | 8/2001 |
| WO | WO 01/66901 | 9/2001 |
| WO | WO 01-79650 | 10/2001 |
| WO | WO 01-81708 | 11/2001 |
| WO | WO 01-83932 | 11/2001 |
| WO | WO 01-94738 | 12/2001 |
| WO | WO 01-94739 | 12/2001 |
| WO | WO 02/14649 | 2/2002 |
| WO | WO 02/29199 | 4/2002 |
| WO | WO 02-44601 | 6/2002 |
| WO | WO 02-081863 | 10/2002 |
| WO | WO 02-086287 | 10/2002 |
| WO | WO 02/092956 | 11/2002 |
| WO | WO 03/006790 | 1/2003 |
| WO | WO 03-074836 | 9/2003 |
| WO | WO 03-087525 | 10/2003 |
| WO | WO 2004/022903 | 3/2004 |

OTHER PUBLICATIONS

Multilateral Case History, Offshore Norway, Baker Hughes, 1995.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utitizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properities, IBP 27500, Brazilian Petroleum Institute—IBP, 2000.
Coiled Tubing Handbook, World Oil, Gulf Publishing Company, 1993.
U.S. Appl. No. 10/189,570, filed Jun. 6, 2002.
U.S. Appl. No. 10/618,093, filed Jul. 11, 2003.
Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.
M.B. Stone and J. Smith, "Expandable Tubulars and Casing Drilling are Options" Drilling Contractor, Jan./Feb. 2002, pp. 52.
M. Gelfgat, "Retractable Bits Development and Application" Transactions of the ASME, vol. 120, Jun. 1998, pp. 124-130.
"First Success with Casing-Drilling" Word Oil, Feb. 1999, pp. 25.
Dean E. Gaddy, Editor, "Russia Shares Technical Know-How with U.S." Oil & Gas Journal, Mar. 1999, pp. 51-52 and 54-56.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Cost By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The America Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill Trips," Petroleum Engineer International, Apr. 1999, p. 15.

Laurent, et al., "A New Generation Drilling Rig: Hydraulically Powered And Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-NO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conferece, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Section 1-10) CANRIG Drilling Technology, Ltd., Sep. 18, 1996.
U.K. Search Report, Application No. GB 0421989.5, dated Jan. 12, 2005.
GB Search Report, Application No. GB0421989.5, dated Dec. 11, 2006.
Tommy Warren, Bruce Houtchens, and Garrett Madell, Directional Drilling With Casing, SPE/IADC 79914, SPE/IADC Drilling Conference, Amsterdam, The Netherlands, Feb. 19-21, 2003, pp. 1-10.
GB Preliminary Examination and Search Report, Application No. 0707336.4, Dated May 25, 2007.

* cited by examiner

METHOD OF DRILLING AND COMPLETING MULTIPLE WELLBORES INSIDE A SINGLE CAISSON

CROSS-REFERENCE TO RELATED APPLICATIONS

This application claims benefit of U.S. provisional patent application Ser. No. 60/508,743, filed Oct. 3, 2003, which is herein incorporated by reference.

BACKGROUND OF THE INVENTION

1. Field of the Invention

Embodiments of the present invention generally relate to drilling and completing wellbores. More specifically, embodiments of the present invention relate to drilling and completing wellbores from within a wellhead.

2. Description of the Related Art

In conventional well completion operations, a wellbore is formed to access hydrocarbon-bearing formations by the use of drilling. In drilling operations, a drilling rig is supported by the subterranean formation. A rig floor of the drilling rig is the surface from which casing strings, cutting structures, and other supplies are lowered to form a subterranean wellbore lined with casing. A hole is located in a portion of the rig floor above the desired location of the wellbore.

Drilling is accomplished by utilizing a cutting structure, preferably a drill bit, that is mounted on the end of a drill support member, commonly known as a drill string. To drill within the wellbore to a predetermined depth, the drill string is often rotated by a top drive or rotary table on the drilling rig, or by a downhole motor mounted towards the lower end of the drill string.

After drilling to a predetermined depth, the drill string and drill bit are removed and a section of casing is lowered into the wellbore. Casing isolates the wellbore from the formation, preventing unwanted fluids such as water from flowing from the formation into the wellbore. An annular area is thus formed between the string of casing and the formation. The casing string is at least temporarily hung from the surface of the well. A cementing operation may then be conducted in order to fill the annular area with cement. Using apparatus known in the art, the casing string may be cemented into the wellbore by circulating cement into the annular area defined between the outer wall of the casing and the borehole. The combination of cement and casing strengthens the wellbore and facilitates the isolation of certain areas of interest in the formation behind the casing for the production of hydrocarbons.

As an alternative to the conventional method, drilling with casing is a method often used to place casing strings of decreasing diameter within the wellbore. This method involves attaching a cutting structure in the form of a drill bit to the same string of casing which will line the wellbore. Rather than running a cutting structure on a drill string, the cutting structure or drill shoe is run in at the end of the casing that will remain in the wellbore and be cemented therein. Drilling with casing is often the preferred method of well completion because only one run-in of the working string into the wellbore is necessary to form and line the wellbore per section of casing placed within the wellbore.

After the wellbore has been lined with casing to the desired depth, the casing is perforated at an area of interest within the formation which contains hydrocarbons. The hydrocarbons flow from the area of interest to the surface of the earth formation to result in the production of the hydrocarbons. Typically, hydrocarbons flow to the surface of the formation through production tubing inserted into the cased wellbore.

Drilling and completing each wellbore typically requires a separate drilling rig, a separate wellhead, and separate associated drilling equipment per wellbore. A wellhead is usually located at the surface of each wellbore, below the drilling rig, and may include facilities for installing a casing hanger for use during well completion operations. The casing may be suspended from the casing hanger during various stages of the well completion by use of a gripping arrangement of slips and packing assemblies (e.g., packing rings). The wellhead also usually includes production equipment such as a production tubing hanger for suspending production tubing, means for installing the valve system used during production operations ("Christmas tree"), and/or means for installing surface flow-control equipment for use in hydrocarbon production operations.

A blowout preventer stack ("BOP stack") is often connected to the top of the wellhead and located below the drilling rig to prevent uncontrolled flow of reservoir fluids into the atmosphere during wellbore operations. The BOP stack includes a valve at the surface of the well that may be closed if control of formation fluids is lost. The design of the BOP stack allows sealing around tubular components in the well, such as drill pipe, casing, or tubing, or sealing around the open hole wellbore. A sealing element is typically elastomeric (e.g., rubber) and may be mechanically squeezed inward to seal drill pipe, casing, tubing, or the open hole. In the alternative, the BOP stack may be equipped with opposed rams.

Historically, one assembly per well drilled and completed, the assembly including a drilling rig, wellhead, and associated drilling and wellhead equipment, has been utilized at multiple surface locations. Therefore, a wellhead and BOP stack must be installed for each well with each drilling rig. Utilizing multiple drilling rigs with their associated wellheads and BOP stacks over the surface of the earth incurs additional cost per drilling rig. The expenditures for each drilling rig, wellhead, and associated equipment; the purchase of and preparation of the additional surface land necessary per drilling rig; and the requirement for additional personnel to install and operate each assembly represent the increased costs. Additionally, safety concerns arise with each drilling rig and wellhead utilized for drilling and completion of a wellbore.

To increase safety and reduce cost per wellbore, it has been suggested that one drilling rig and associated wellhead may be utilized to drill and complete multiple wellbores. When one drilling rig is utilized to complete multiple wellbores, the drilling rig must be moved to each new location to drill and complete each well. Each moving of the drilling rig and wellhead incurs additional cost and provides additional safety risks. At each new location to which the drilling rig is moved, the wellhead must be removed from the old location and then re-installed at the new location by drilling, thus providing additional cost and safety concern per well drilled. Translating the position of the drilling rig and wellhead also requires removing the BOP stack and other drilling equipment from the old location, and then "rigging down" the drilling equipment, including the BOP stack, at the new location. Changing drilling rig position further requires otherwise preparing the wellhead for drilling and completion operations at the location to which the wellhead is moved, such as "tying back" the casing within the wellbore to the surface by connecting a casing string to the casing so that a sealed fluid path exists from the casing to the surface. Furthermore, any change in position of the drilling rig provides the risk of a blowout, spillage, or other safety breach due to disturbance of wellbore conditions.

A recent development in drilling and completing multiple wellbores from one drilling rig and associated wellhead involves directionally drilling the wellbores from one drilling rig and wellhead from proximate surface locations. Directional drilling may be utilized to deviate the direction and orientation of each wellbore so that the multiple wellbores do not intersect. If the wellbores are prevented from intersecting, each wellbore becomes a potentially independent source for hydrocarbon production, often from multiple areas of interest or hydrocarbon production zones.

Because of regulations permitting a limited number of drilling platforms which may be utilized to drill offshore wells, wellbores are often deviated from vertical to increase the amount of wells which may be drilled from a single platform. When drilling an offshore wellbore, a preformed template may be used to guide the location and diameter of the wellbores drilled from the drilling rig. The wellbores are drilled from the template along the well paths dictated by the template to the desired depths.

Directionally drilling the wellbores from one drilling rig and wellhead at proximate surface locations does not alleviate the inherent safety and economic problems which arise with moving the drilling rig and, consequently, the wellhead, as described above. The current apparatus and methods for drilling multiple wellbores from the nearby locations still require at least slight movement of the drilling rig and associated wellhead along the surface. Even slight movement, e.g. 6-8 inches of movement, of the drilling rig along the surface, often termed "skidding the rig", imposes the additional costs and safety risks involved in removing the wellhead and BOP stack from the first location and "rigging down" the drilling rig, including preparing the wellhead and the BOP stack, for subsequent operations at the second location.

There is therefore a need for a method and apparatus for drilling and completing multiple wellbores from one drilling rig and wellhead without moving the drilling rig or wellhead. There is a further need for an apparatus and method which provides a decrease in the land, cost, and time necessary to drill and complete multiple wellbores. There is a further need for an apparatus and method for completing multiple deviated wellbores from one drilling rig and associated wellhead without moving the drilling rig. There is a yet further need for a more aesthetically and environmentally pleasing method for drilling and completing multiple wellbores.

SUMMARY OF THE INVENTION

In one aspect, the present invention provides a method for drilling multiple wellbores into an earth formation using one wellhead, comprising providing casing extending downhole from a surface of the earth formation; drilling a first wellbore below the casing; and lowering a template having at least two bores therein and a first casing string disposed within a first bore of the at least two bores to a predetermined depth within the casing. In another aspect, the present invention provides a method for drilling multiple wellbores from a single wellhead, comprising providing a wellhead at a surface of an earth formation and a casing within the earth formation; drilling a first wellbore below the casing; locating a template downhole within the casing while casing the first wellbore; and drilling and casing a second wellbore below the casing through the template, wherein drilling and casing the first wellbore and the second wellbore is accomplished without moving the wellhead.

In an additional aspect, embodiments of the present invention include a method for drilling at least two wellbores into an earth formation from a casing within a parent wellbore using one wellhead, comprising providing the casing extending downhole from a surface of the formation, the casing having a first portion and a second portion, the second portion having a smaller inner diameter than the first portion; forming a first wellbore in the formation from the second portion; and forming a second wellbore from the first portion by drilling through a wall of the casing and into the formation. In yet another aspect, embodiments of the present invention provide a method of forming first and second wellbores from a casing using a common wellhead, comprising providing the casing in a wellbore, the casing comprising an upper portion having a first inner diameter; a lower portion having a second, smaller inner diameter; and a connecting portion connecting the upper and lower portions, the centerlines of the upper and lower portions offset; forming the first wellbore from the lower portion; and forming the second wellbore into the formation through a wall of the upper portion, using the connecting portion as a guide.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The apparatus and methods of the present invention allow multiple wellbores to be drilled into the formation with one drilling rig and wellhead. Drilling multiple wellbores from one drilling rig and wellhead reduces the cost and time expended, as well as increases the safety of the drilling and completion of the wellbores by decreasing the amount of equipment necessary to drill and complete each wellbore, decreasing the amount of personnel necessary for operations related to each wellbore, and decreasing the amount of land necessary to reach the hydrocarbons by drilling the wellbores. Additionally, drilling multiple wellbores from one drilling rig and wellhead decreases the surface area occupied by visible well equipment, so that more wells may be drilled from a smaller area using common equipment, thus providing a more aesthetically pleasing land surface in the environment.

Multiple wellbores may be drilled with the present invention from one location without removing the wellhead and BOP stack from the old location, moving the drilling rig from the old location to the new location, and then re-installing the wellhead and the BOP stack at the new location. The ability to form multiple wellbores from one drilling rig and wellhead without skidding the rig eliminates the cost of "rigging down" and otherwise preparing the BOP stack and the wellhead, as well as increases safety at the well site due to decreased instances of upsetting the balance of the well by moving the drilling rig. Furthermore, the ability to form multiple wellbores from one drilling rig and wellhead without moving the drilling rig reduces environmental concerns that may arise from moving the drilling rig to multiple locations, such as the potential for spillage and/or blowouts.

The present invention allows for only one rigging down of the drilling rig, wellhead, and BOP stack during drilling, completion, and production of multiple wellbores. Furthermore, the present invention eliminates additional preparation of the wellsite which ensues when multiple wellbores are drilled from multiple locations.

The discussion below focuses primarily on drilling two wellbores from one drilling location without moving the drilling equipment. The principles of the present invention also allow for the formation of multiple wellbores from one drilling location using one drilling rig and wellhead without moving the drilling rig or wellhead.

Figure 1:
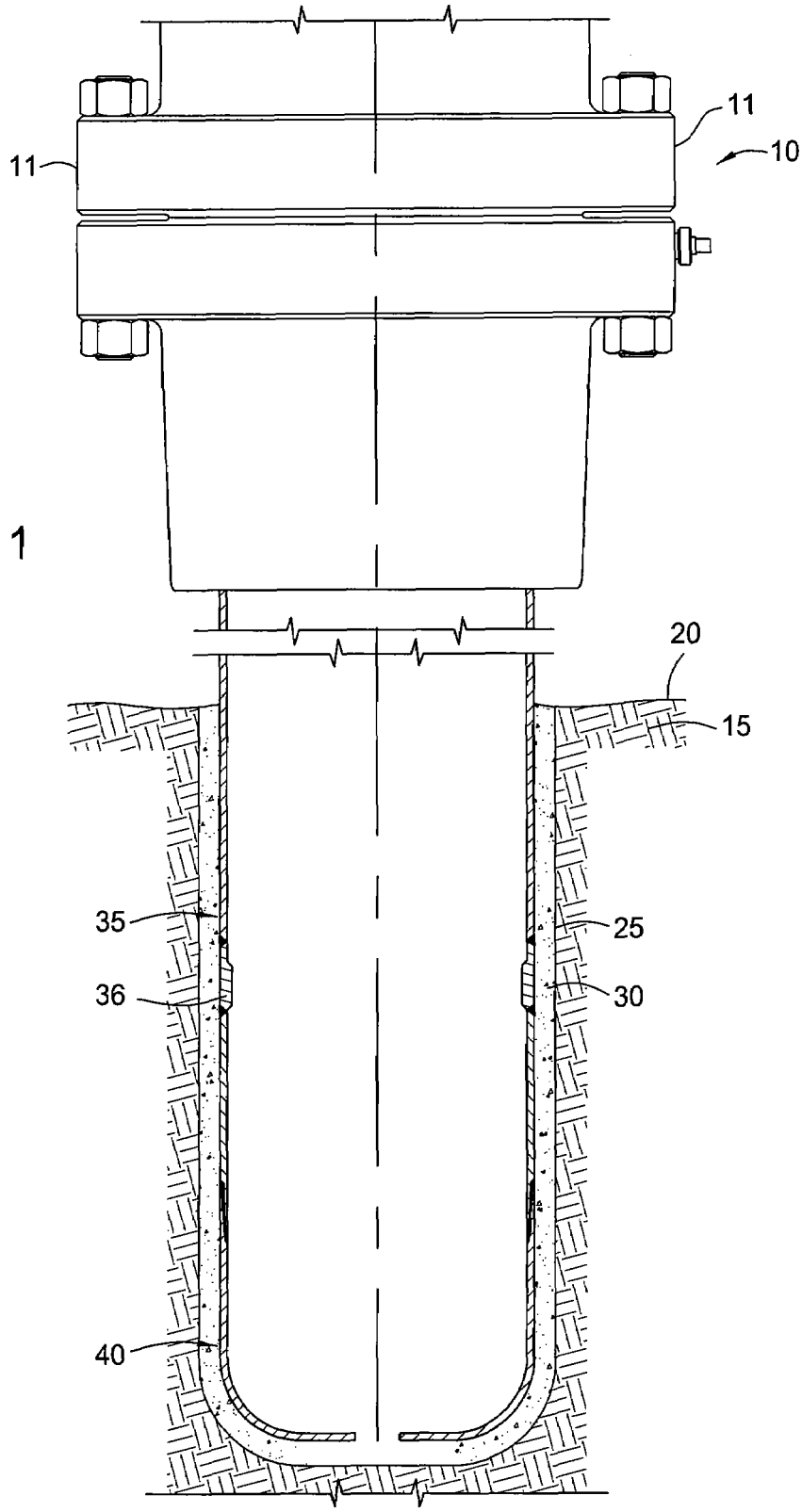
FIG. 1 is a cross-sectional view of surface casing of a first embodiment of the present invention within a wellbore.

A first embodiment of the present invention is shown in FIGS. 1-8. FIG. 1 shows a wellhead 10 located at a surface 20 of a wellbore 25 formed within an earth formation 15. A drilling rig (not shown) is located above the wellhead 10 to allow lowering of equipment through the wellhead 10 from the drilling rig. A BOP stack (not shown) is preferably connected to the upper portion of the wellhead 10 to prevent blowouts and other disturbances. The wellhead 10 has dual adapters 11 located opposite from one another across the wellhead 10.

Surface casing 35 extends from within the wellhead 10 into the wellbore 25. The surface casing 35 preferably has an outer diameter of approximately 16 inches, although the surface casing 35 diameter is not limited to this size. When drilling more than two wellbores from within the surface casing 35, the surface casing may be approximately 36 inches in outer diameter or greater. The surface casing 35 may include one or more casing sections threadedly connected to one another.

A cement shoe 40 may be threadedly connected to a lower end of the surface casing 35, although it is not necessary to the present invention. The cement shoe 40 aids in cementing the surface casing 35 within the wellbore 25, as a check valve (not shown) disposed within the cement shoe 40 allows cement to pass downward through the surface casing 35 and out through the check valve, but prevents cement flow back up through the surface casing 35 to the surface 20. In FIG. 1, cement 30 is shown within the annulus between the surface casing 35 and the wellbore 25. The cement 30 and the cement shoe 40 are consistent with one embodiment of the present invention. In another embodiment, the surface casing 35 is retained in place within the wellbore 25 for subsequent operations by hangers within the wellhead 10 or other means known by those skilled in the art to suspend tubulars at a position within the wellbore.

Figure 3:
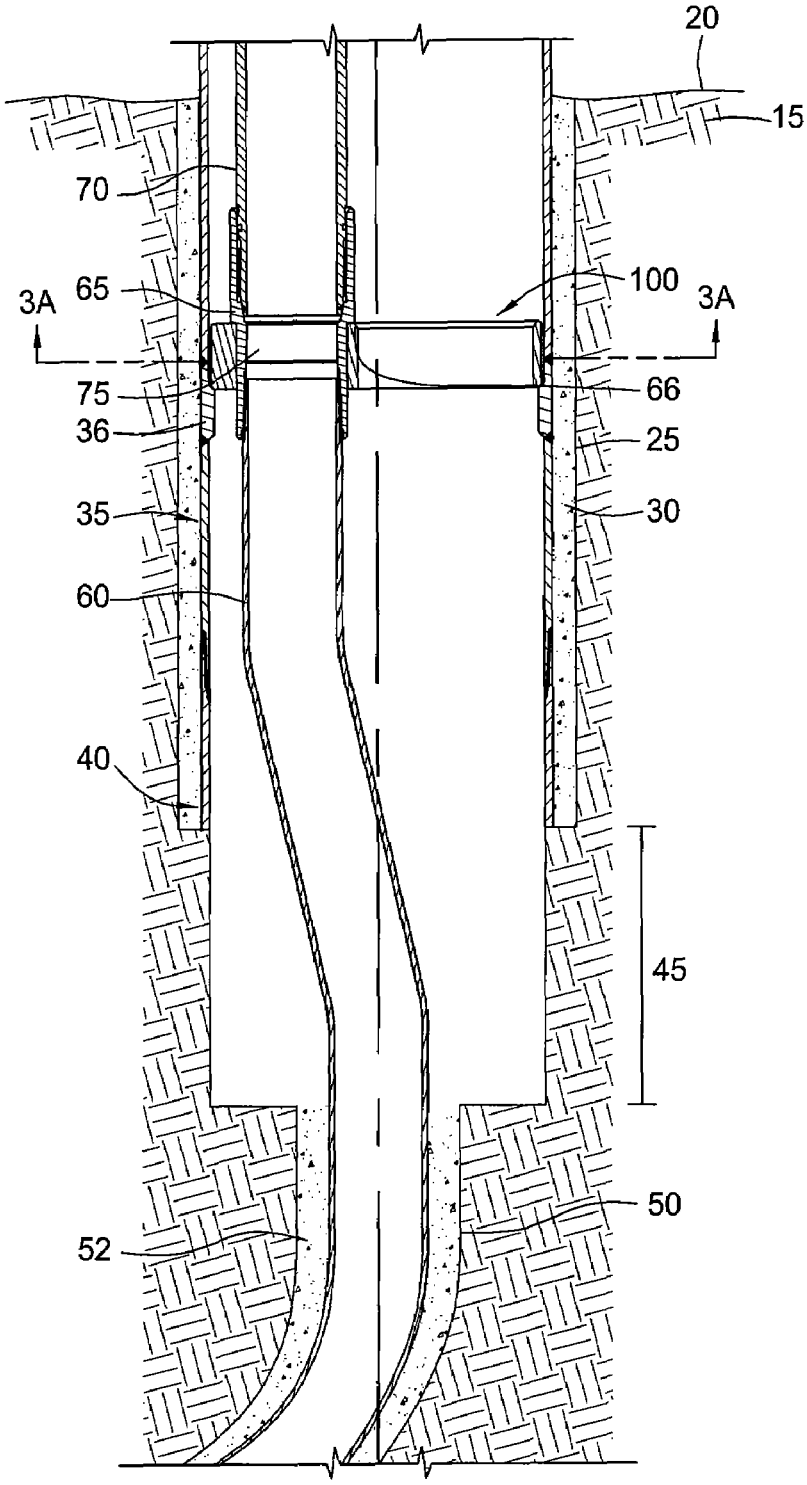
FIG. 3 is a cross-sectional view of a first casing string disposed within the first wellbore of FIG. 2. The first casing string is disposed in a first slot in a template.

The surface casing 35 has an upset portion 36 which provides a restricted inner diameter within the surface casing 35. The upset portion 36 may be included in another piece of equipment in the surface casing 35, including but not limited to the float shoe 40. The upset portion 36 may include at least two tabs extending inward from the inner diameter of the surface casing 35, or the upset portion 36 may include a circumferential inner diameter restriction extending inward from the inner diameter of the surface casing 35. The inner diameter restriction may include any mechanism capable of retaining a template 100, as shown in FIG. 3 and described below. It is also contemplated that the template 100 may be retained at the desired location within the surface casing 35 by means other than an inner diameter restriction, including but not limited to one or more pins or a threadable connection.

Figure 2:
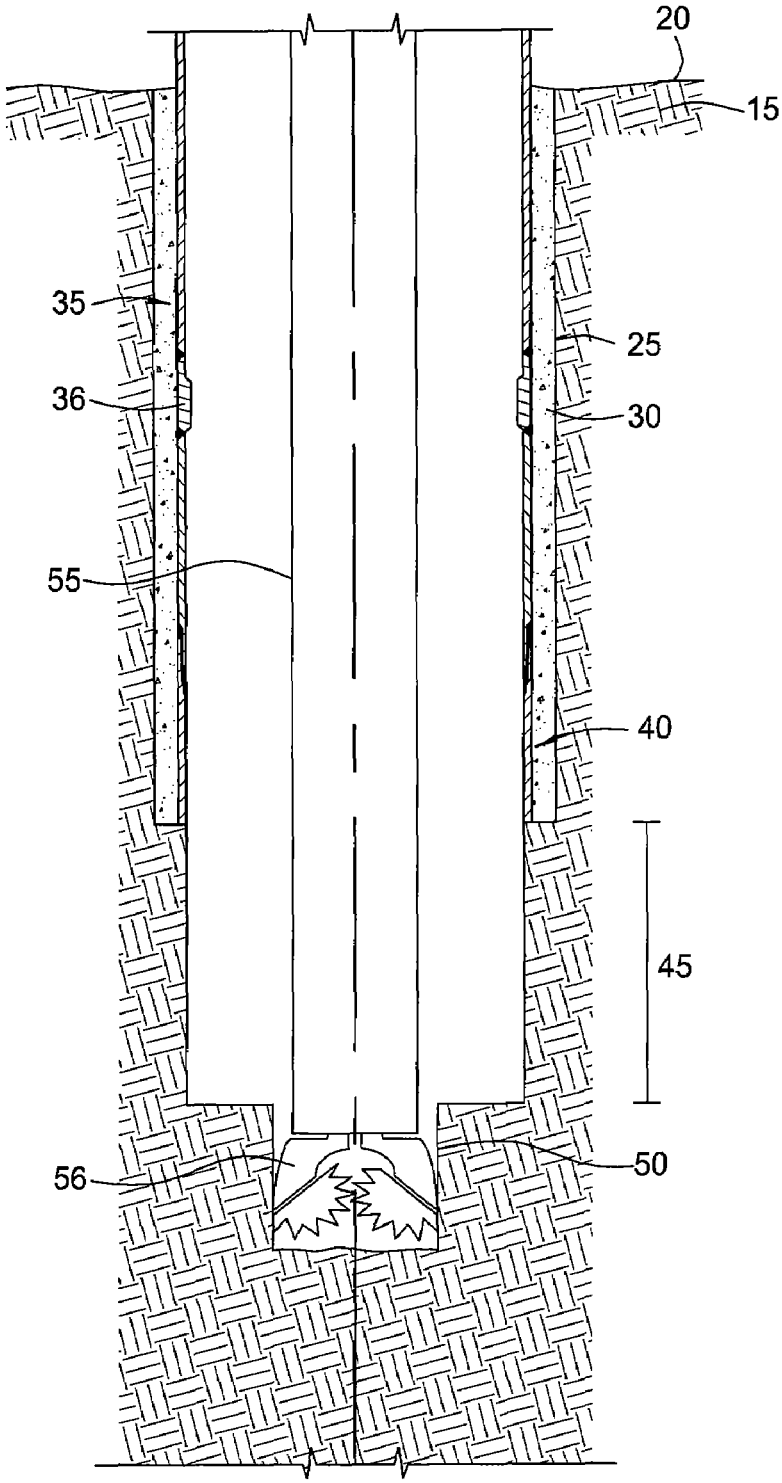
FIG. 2 is a cross-sectional view of the surface casing of FIG. 1. The wellbore is shown extended below the surface casing, and a first wellbore is being drilled into the formation from the extended wellbore.

FIG. 2 shows the surface casing 35 cemented within the wellbore 25. Although FIGS. 2-7 do not show the wellhead 10 shown in FIG. 1, the wellhead 10 exists above the surface casing 35 in all of the figures. In FIG. 2, a portion of the cement shoe 40 remains threadedly connected to the surface casing 35, but a lower end of the cement shoe 40 has been drilled out with a drill string (not shown) which is used to drill an extended wellbore portion 45. The extended wellbore portion 45 preferably approaches the inner diameter of the surface casing 35; however, it is contemplated that the extended wellbore portion 45 may be of any diameter through which two wellbores (deviated or non-deviated wellbores) may be drilled, as described below. The extended wellbore portion 45 provides room for manipulating the casing strings (see below) to allow placement of the casing strings into the deviated wellbores at the correct orientation, according to the process described below.

A drill string 55 is shown in FIG. 2 drilling a first wellbore 50. A cutting structure 56, including but not limited to a drill bit, is used to drill through the formation 15 to form the first wellbore 50. A portion of the first wellbore 50 is shown drilled out by the cutting structure 56.

FIG. 3 shows a template 100 located on the upset portion 36 within the surface casing 35. The upset portion 36 is preferably disposed at a depth of approximately 1-2000 feet so that the template 100 is finally located to rest on the upset portion 36 at that depth. A first casing string 60 is located within the template 100. The first casing string 60 preferably has an outer diameter of approximately 4½ inches, but the first casing string 60 is not limited to an outer diameter of that size. The first casing string 60 is threadedly connected to a running string 70 by a coupling 65. The running string 70 may be any type of tubular, including but not limited to casing and pipe. The running string 70 may include one or more tubular sections threadedly connected to one another, and the first casing string 60 may include one or more casing sections threadedly connected to one another.

Figure 3A:
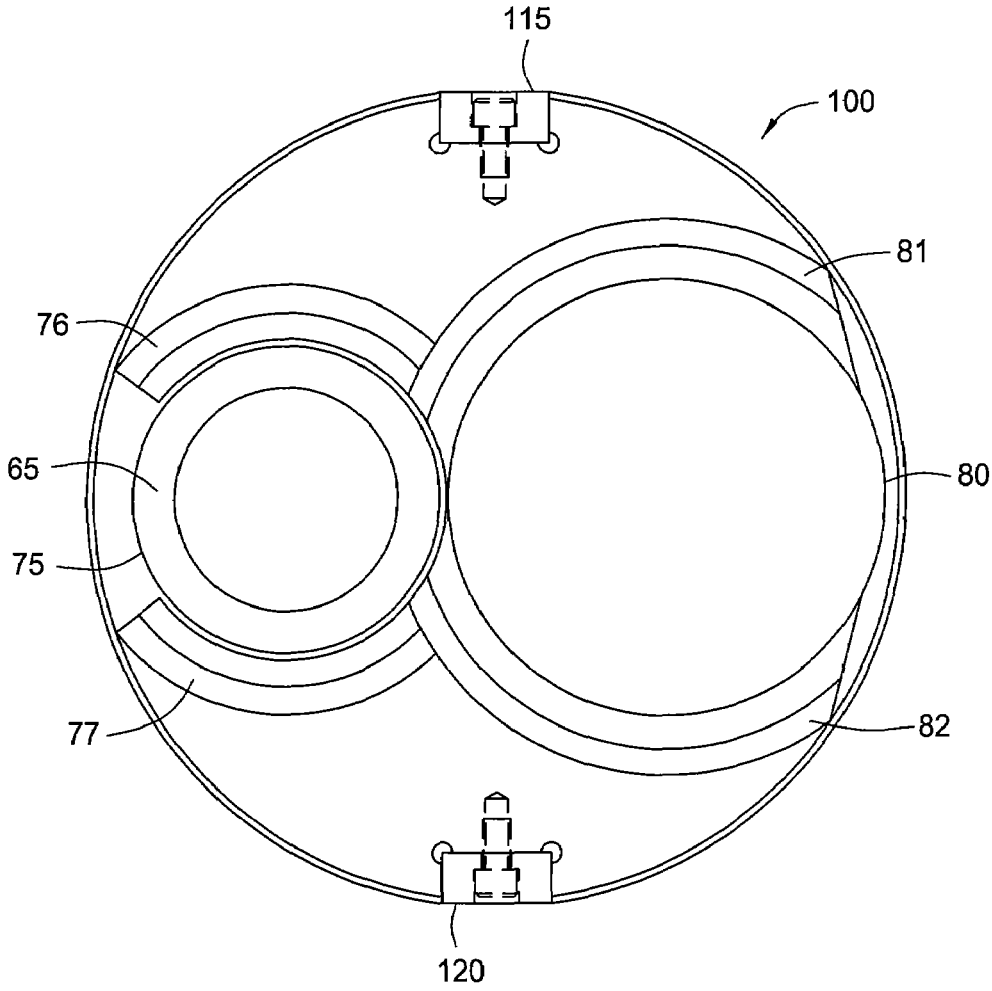
FIG. 3A shows a downward view of the template along line 3A-3A of FIG. 3.

The coupling 65 has a shoulder 66 extending therefrom to retain the first casing string 60 and the running string 70 in position. The first casing string 60 extends below the template 100, the running string 70 extends above the template 100, and the coupling 65 extends above and below the template 100 and within a first slot 75 in the template 100. The first slot 75 is a first bore running through the template 100, as shown in FIG. 3A. The shoulder 66 of the coupling 65 rests on the template 100. It is also contemplated that any portion of the first casing string 60 may be retained with the template 100 using any other apparatus or method known to those skilled in the art.

The running string 70 extends to the surface 20 and up into the wellhead 10 (see FIG. 1). The first casing string 60 extends through the surface casing 35, through the extended wellbore 45, and into the first wellbore 50. Cement 52 is shown in the annulus between the first casing string 60 and the first wellbore 50. The cement 52 may extend above the annulus between the first casing string 60 and the first wellbore 50 into the annulus between the first casing string 60 and the extended wellbore 45, and even into the annulus between the first casing string 60 and the surface casing 35. It is also contemplated that the first casing string 60 does not have to be cemented into the first wellbore 50.

A downward view of the template 100 along line 3A-3A of FIG. 3 is shown in FIG. 3A. The first slot 75 has the coupling 65 located therein. Funnels 76 and 77 are mounted on the template 100 around the first slot 75 to guide the orientation of the first casing string 60 to allow it to deviate into the first wellbore 50 (shown in FIG. 3). Any number of funnels 76 and 77 may be employed to guide and angle the first casing string 60 into the first wellbore 50. The funnels 76 and 77 are disposed at the distance from the first slot 75 and at angles with respect to the first slot 75 calculated to guide and angle the first casing string 60 into the first wellbore 50.

FIG. 3A also shows a second slot 80 on the template 100. The second slot 80 is a second bore running through the template 100. The second slot 80 is shown as having a larger diameter than the first slot 75, but it is also contemplated to be of the same diameter as the first slot 75 or of a smaller diameter than the first slot 75. Preferably, the diameter of the second slot 80 is larger than the diameter of the first slot 75 so that a large enough drill string 90 may be inserted through the second slot 80 to drill a second wellbore 95 of a desired diameter for inserting a second casing string 105 of the desired size (see FIGS. 5-6), as described below in relation to FIGS. 5-6. The second slot 80 has funnels 81 and 82 mounted around it on the template 100 to guide the orientation of the second casing string 105 (see FIGS. 6-7). As with the funnels 76 and 77, any number of funnels 81 and 82 may be used, and the funnels 81 and 82 may be disposed at the distance and the angle with respect to the second slot 80 contemplated to guide and angle the second casing string 105 into the second wellbore 95. Lugs 115 and 120 may be located near the outer diameter of the template 100 on opposing sides of the template 100.

Figure 4:
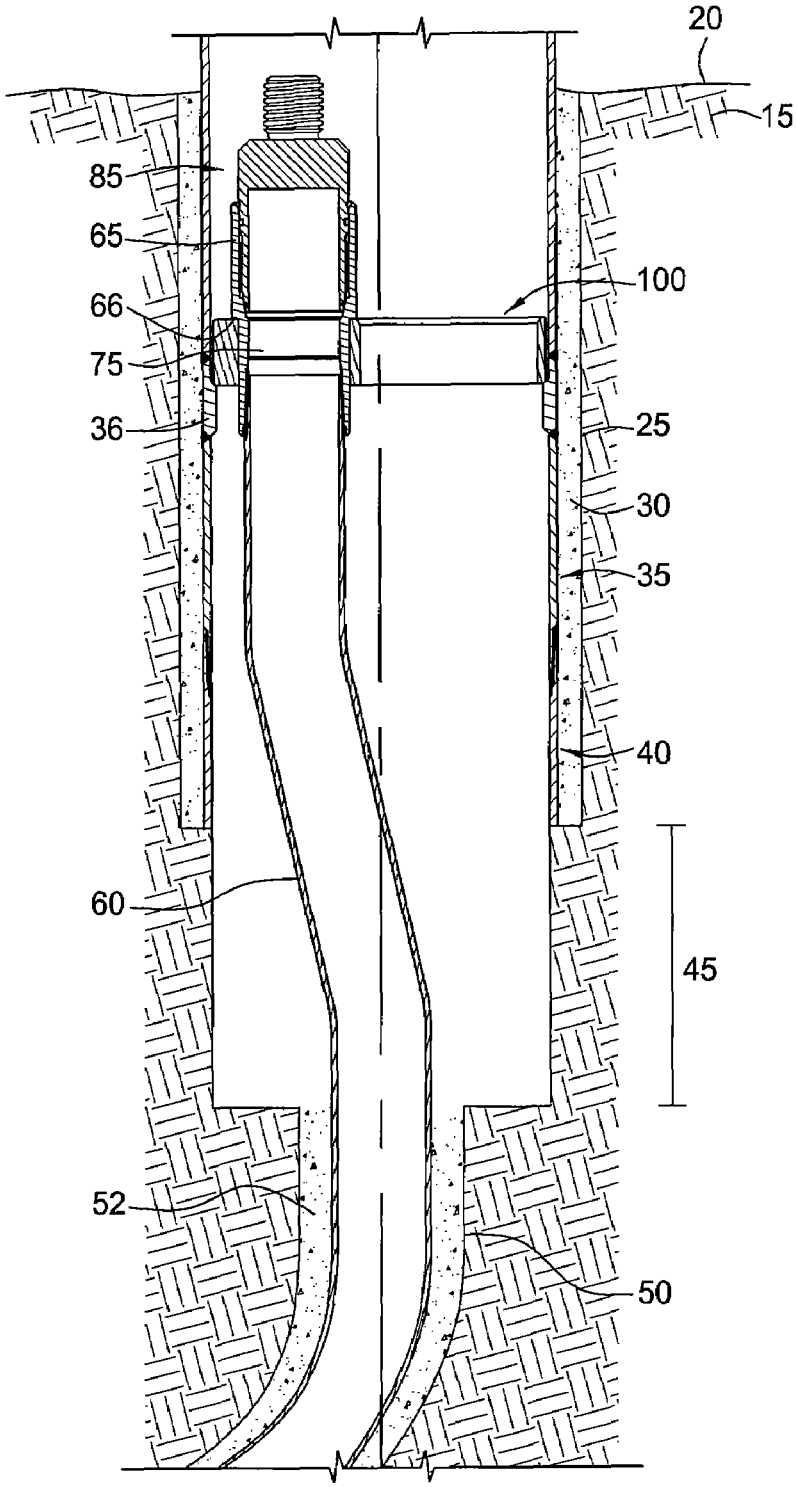
FIG. 4 shows a plug connected to an upper end of the first casing string of FIG. 3.

FIG. 4 shows the running string 70 of FIG. 3 replaced with a plug 85. The plug 85 prevents debris from entering the first casing string 60 during subsequent operations.

Figure 5:
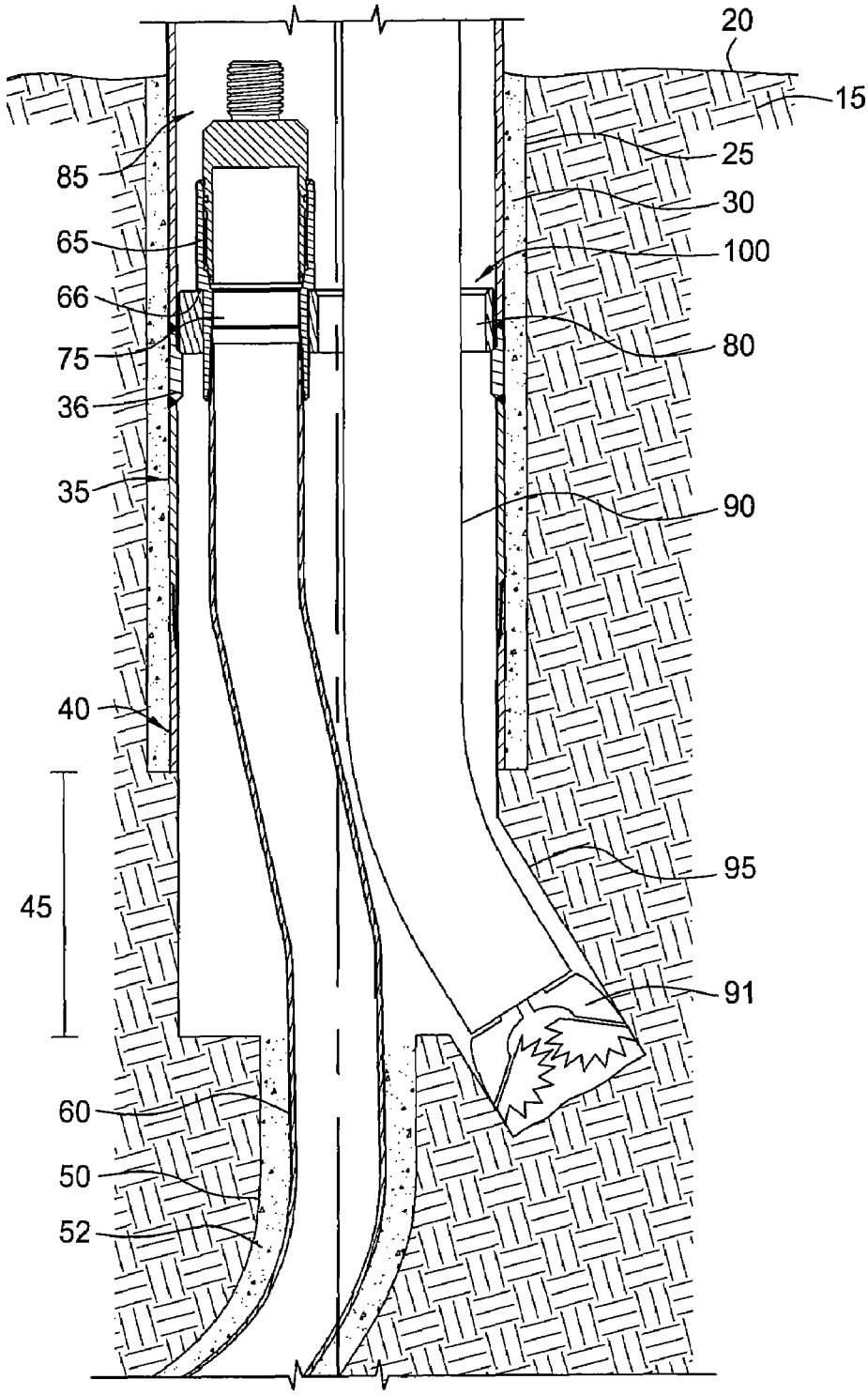
FIG. 5 is a cross-sectional view of the surface casing with the first casing string disposed within the first wellbore of FIG. 3. A second wellbore is drilled through a second slot in the template.

FIG. 5 shows a drill string 90 with a cutting structure 91, preferably a drill bit, attached thereto drilling a second wellbore 95 into the formation 15. The drill string 90 is placed through the second slot 80.

Figure 6:
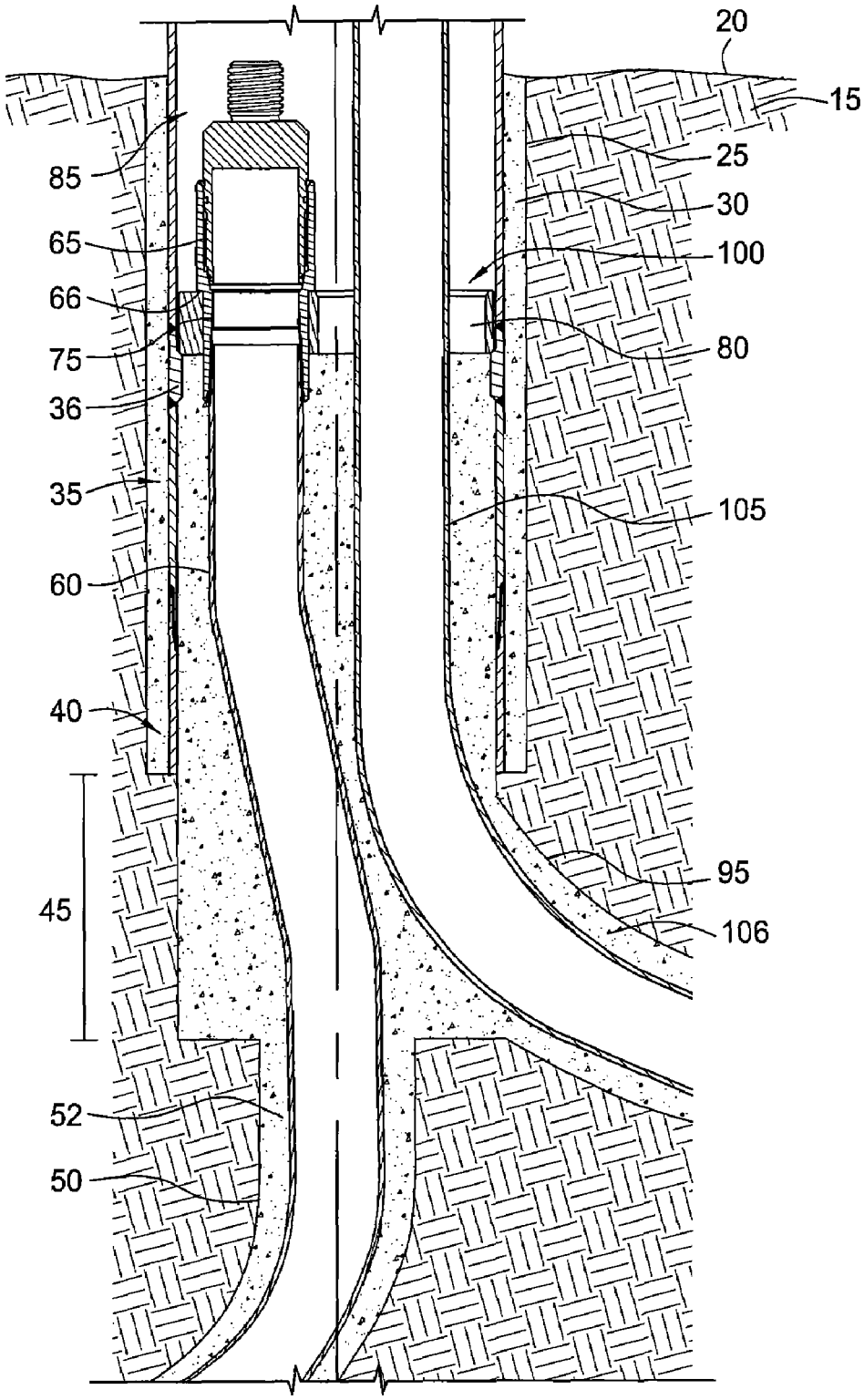
FIG. 6 shows the first casing string disposed within the first wellbore and a second casing string disposed within the second wellbore.

FIG. 6 shows a second casing string 105 located within the second slot 80, through the surface casing 35, through the extended wellbore 45, and into the second wellbore 95. The second casing string 105 preferably has an outer diameter of 4½ inches, although the outer diameter of the second casing string 105 is not limited to this size. Cement 106 is shown occupying the annulus between the second wellbore 95 and the second casing string 105, as well as within the portion of the surface casing 35 and the extended wellbore 45 which is not occupied by the first casing string 60 or the second casing string 105. The cement 106 may be allowed to rise to any level within the second wellbore 95, the extended wellbore 45, or the surface casing 35, and is not required to rise up to the template 100, as shown in FIG. 6. Additionally, it is contemplated that the present invention is operable without cement 106, as well as without cement 30 or 52.

Figure 7:
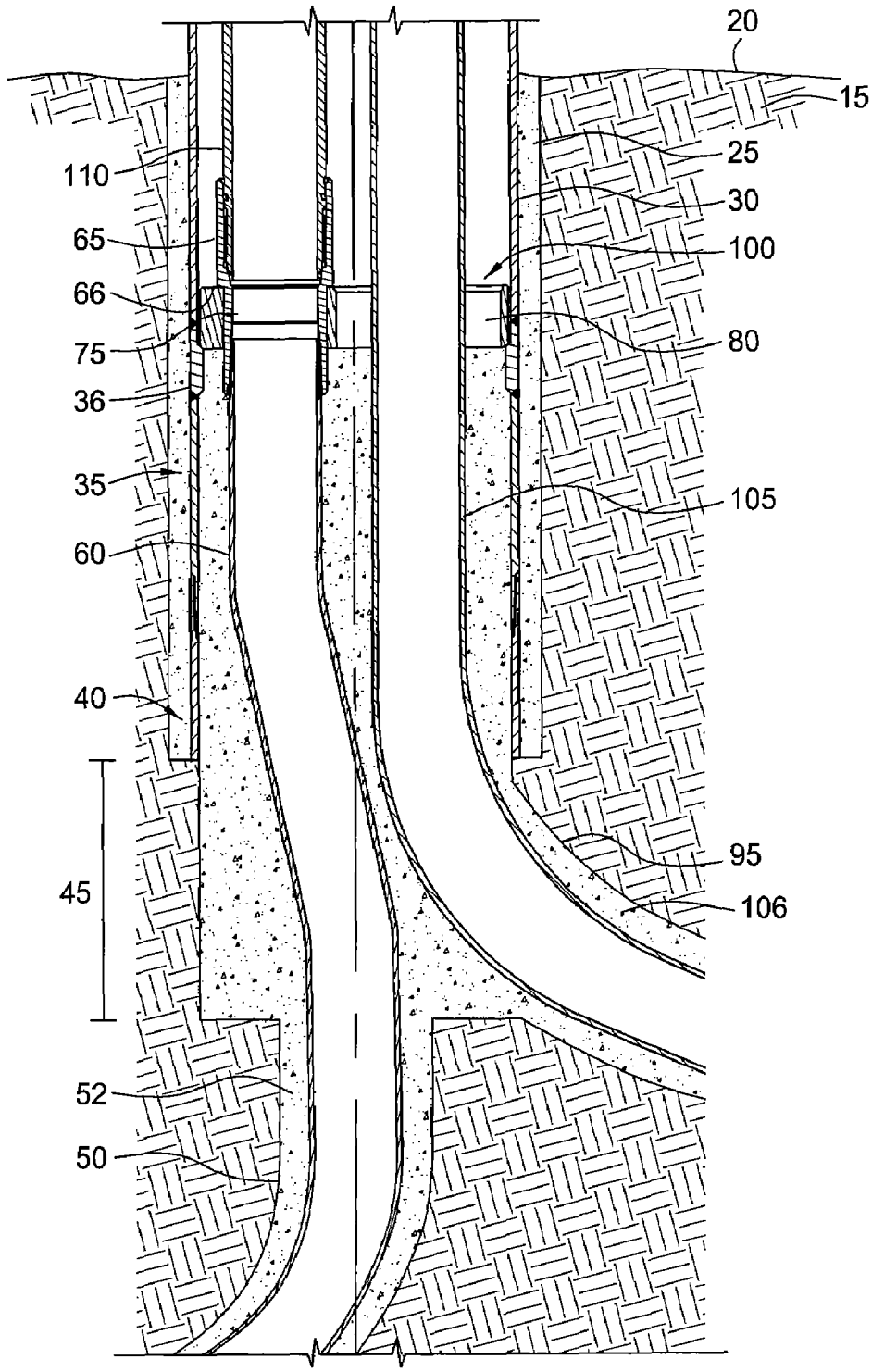
FIG. 7 shows a casing string connected to the upper end of the first casing string.

FIG. 7 shows the first and second casing strings 60 and 105 disposed within the first and second wellbores 50 and 95. The plug 85 has been removed, and a casing string 110 has been connected to the first casing string 60 by the coupling 65. The casing string 110 may include one or more casing sections threadedly connected to one another. The casing string 110 extends to the surface 20 of the wellbore 25.

Figure 8:
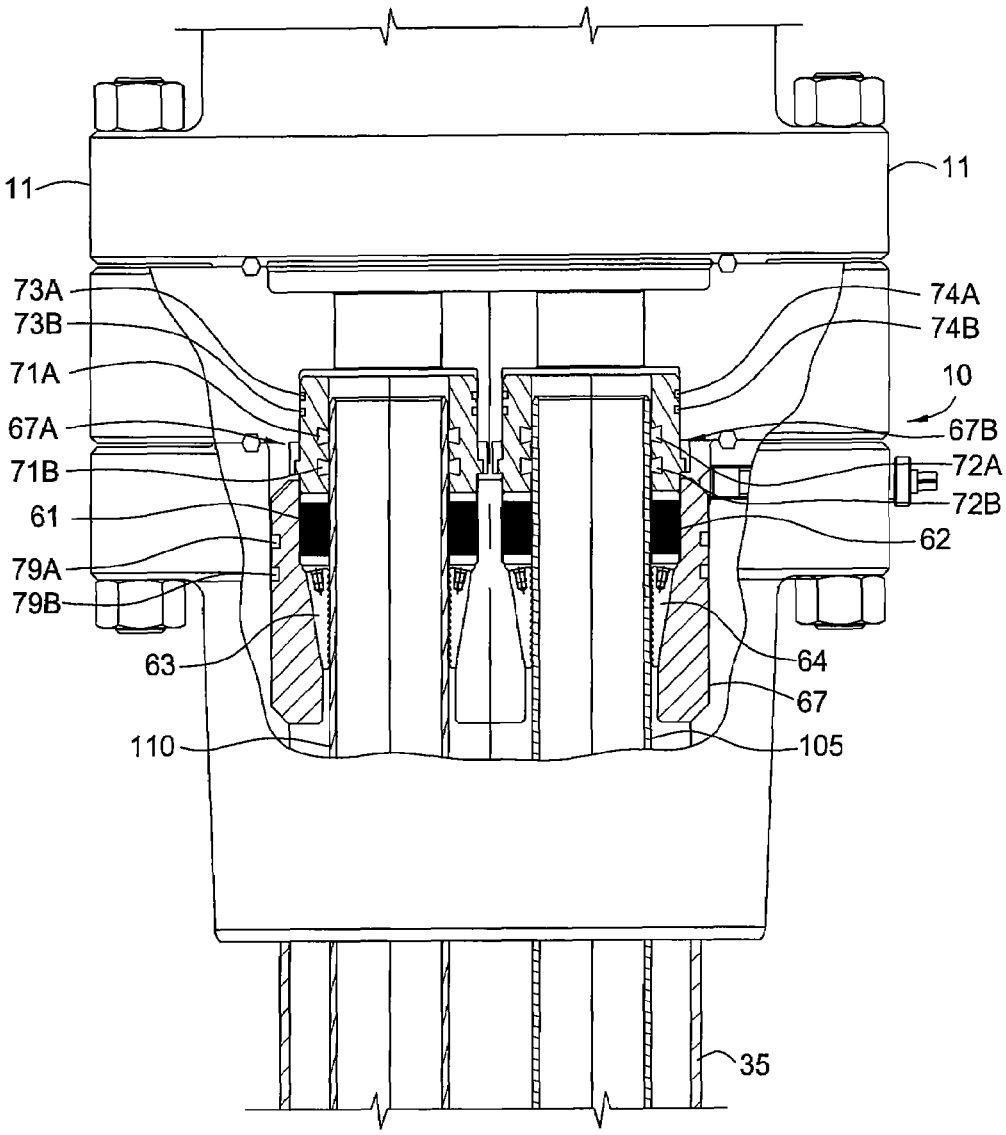
FIG. 8 shows the second casing string and the casing string connected to the upper end of the first casing string engaged by a dual hanger within a wellhead.

FIG. 8 shows a dual hanger 67 within the wellhead 10. Disposed within the dual hanger 67 are sealing element 61, which is used to sealingly engage the casing string 110, and sealing element 62, which is used to seal around the second casing string 105. The sealing elements 61 and 62 are preferably packing elements. Also disposed within the dual hanger 67 are gripping elements 63 and 64. The gripping element 63 is used to grippingly engage the casing string 110, while the gripping element 64 is utilized to grippingly engage the second casing string 105. The gripping elements 63 and 64 preferably include slips.

Seals 71A-B are disposed between the dual hanger 67 and the casing string 110. Seals 72A-B are disposed between the dual hanger 67 and the second casing string 105. Seals 73A-B are disposed between the upper portion of the portion 67A of the dual hanger 67 housing the casing string 110 and the wellhead 10, while seals 74A-B are disposed between the upper portion of the portion 67B of the dual hanger 67 housing the second casing string 105 and the wellhead 10. Seals 79A-B are disposed between the lower portion of the dual hanger 67 and the inner surface of the wellhead 10. The seals 71A-B, 72A-B, 73A-B, 74A-B, and 79A-B may include any type of seal, including for example o-rings. The seals 71A-B, 72A-B, 73A-B, 74A-B, and 79A-B function to isolate the casing strings 110 and 105 from one another as well as seal between the dual hanger 67 and the wellhead 10. Any number of seals may be utilized with the present invention.

In operation, the wellhead 10 is placed below the drilling rig and above the desired location for drilling wellbores. The BOP stack and various other wellhead equipment are installed on or in the wellhead 10. A drill string (not shown) is inserted from the drilling rig and through the wellhead 10 into the formation 15 to drill the wellbore 25 (see FIG. 1) into the formation 15. The drill string is then removed from the wellbore 25 to the surface 20 when the wellbore 25 is of a sufficient depth to insert the surface casing 35 to the desired depth. Next, as shown in FIG. 1, the surface casing 35 is inserted into the wellbore 25. The surface casing 35 is hung by hangers (not shown) located within the wellhead 10, or by other means known by those skilled in the art. Optionally, the surface casing 35 may be set within the wellbore 25 by placing cement 30 within the annulus between the surface casing 35 and the wellbore 25. When utilized, and as shown in FIG. 1, the cement 30 is introduced into the inner diameter of the surface casing 35 and flows through the cement shoe 40, then up through the annulus between the surface casing 35 and the wellbore 25.

In an alternate embodiment which is not shown, the surface casing 35 may be utilized to drill the wellbore 25. In this embodiment, rather than the cement shoe 40 being located at the lower end of the surface casing 35, an earth removal member, preferably a drill bit, is operatively connected to the lower end of the surface casing 35. The surface casing 35 drills into the formation 15 to the desired depth, then cement may optionally be introduced into the annulus between the surface casing 35 and the wellbore 25. Drilling with the surface casing 35 allows forming of the wellbore 25 and placing the surface casing 35 into the formation 15 to be consolidated into one step, so that the wellbore 25 is drilled and the surface casing 35 is simultaneously placed within the formation 15.

After the surface casing 35 is placed within the wellbore 25 at the desired location, a drill string (not shown) may be inserted into the surface casing 35. The drill string is preferably capable of drilling an extended wellbore 45 which possesses a diameter at least as large as the inner diameter of the surface casing 35. The extended wellbore 45 is shown in FIG. 2. When using a cement shoe 40, the drill string drills through the lower portion of the cement shoe 40 to form the extended wellbore 45. Also, if any cement 40 exists below the surface casing 35, the drill string drills through this cement. When drilling with the surface casing 35, the earth removal member may be drillable by the drill string. The drill string is then removed from the extended wellbore 45 and the wellbore 25. For the present invention, the extended wellbore 45 is included in a preferable embodiment, but is not necessary in all embodiments, as the first and second wellbores 50 and 95 may be drilled from a lower end of the surface casing 35.

Next, as shown in FIG. 2, the drill string 55 with the cutting structure 56 attached thereto is used drill the first wellbore 50 into the formation 15. The cutting structure 56 is preferably capable of drilling a smaller diameter hole than the drill string used to drill the extended wellbore 45. The first wellbore 50 may be drilled from any portion of the extended wellbore 45. In the alternative, the first wellbore 50 may be drilled from the lower end of the surface casing 35 in the absence of the extended wellbore 45. In FIGS. 2-7, the first wellbore 50 is drilled from a central portion of the extended wellbore 45 for purposes of illustration only. FIG. 2 shows the first wellbore 50 being drilled into the formation 15 by the drill string 55.

The cutting structure 56 is preferably a drill bit capable of directionally drilling to alter the trajectory of the first wellbore 50. The drill string 55 may then deviate the first wellbore 50 to reach the area of interest within the formation 15, such as the area which contains hydrocarbons for recovering. For example, the cutting structure 56 may be a jet deflection bit (not shown), the structure and operation of which is known to those skilled in the art. Alternatively, pads (not shown) may be placed on the drill string 55 to bias the drill string 55 and alter its orientation. Any other known apparatus or method known to those skilled in the art may be utilized to alter the trajectory of the first wellbore 50.

After drilling the first wellbore 50 to the desired depth, the drill string 55 is removed from the first wellbore 50, extended wellbore 45, and wellbore 25. Referring now to FIG. 3, prior to running the template 100 into the wellbore 25, an upper end of the first casing string 60 is coupled to a lower end of the running string 70 by the coupling 65. The first casing string 60 and running string 70 connected by the coupling 65 is placed within the first slot 75 of the template 100 until the shoulder 66 of the coupling 65 rests on the template 100, thus preventing further movement of the coupling 65, first casing string 60, and running string 70 through the first slot 75.

Next, the template 100 having the first casing string 60 disposed therein is lowered into the surface casing 35. The lugs 115 and 120 help orient the template 100 within the surface casing 35 while the template 100 is being run into the surface casing 35, so that the slots 75 and 80 are in the desired position, namely the position at which the casing strings 60 and 105 may be manipulated into their respective wellbores 50 and 95. Any number of lugs 115 and 120 may be utilized to orient the template 100, including just one lug. Furthermore, no lugs may be employed if desired. Any other type of anti-rotation device may be utilized with the present invention to prevent rotation of and orient the template 100.

As is evident in FIG. 3, even when the template 100 is oriented correctly within the surface casing 35 by the lugs 115 and 120, due to directional drilling the entirety of the first wellbore 60 may not be in longitudinal line with the first slot 75 and the first casing string 60 that is disposed within the first slot 75 (although the present invention also includes drilling a first wellbore 50 which is directly below the first slot 75). The funnels 76 and 77 aid in manipulating the first casing string 60 through the portion of the surface casing 35 below the upset portion 36 and through the extended wellbore 45 so that the first casing string 60 is guided to enter into the first wellbore 50. The first casing string 60 is preferably flexible enough to allow for manipulation of the first casing string 60 to allow it to travel into and through the first wellbore 50 at an angle. After the first casing string 60 initially enters the first wellbore 50, the first casing string 60 follows the deviation of the drilled first wellbore 50 as the first casing string 60 is further lowered into the first wellbore 50.

The template 100 with the first casing string 60 located therein is lowered into the surface casing 35 until the outer portion of the template 100 rests on the upset portion 36 of the surface casing 35. The outer surface of the portion of the template 100 which will rest of the upset portion 36 is larger than the inner surface of the upset portion 36, so that the template 100 cannot travel into the wellbore 25 to a further depth than the upset portion 36. The lugs 115 and 120 maintain the template 100 at the correct orientation and prevent the template 100 from rotating while the template 100 is lowered into position. Furthermore, the lugs 115 and 120 maintain the template 100 in the desired position and prevent rotating of the template 100 relative to the surface casing 35 once the template 100 is stopped on the upset portion 36. Accordingly, the template 100 suspends the first casing string 60 in position downhole at a predetermined depth.

Once the template 100 is placed on the upset portion 36, cement 52 may be provided within the annulus between the first casing string 60 and the first wellbore 50. To provide cement 52 within the annulus, cement 52 is introduced into the running string 70, then flows through the first casing string 60, out through the lower end (not shown) of the first casing string 60, and up through the annulus between the first casing string 60 and the first wellbore 50. FIG. 3 shows cement 52 throughout the annulus between the first casing string 60 and the first wellbore 50, ending at the extended wellbore 45. In the alternative, the cement 52 may only partially fill the annulus, may be allowed to fill a portion or all of the annulus between the first casing string 60 and the extended wellbore 45, or may be allowed to fill a portion or all of the annulus between the first casing string 60 and the surface casing 35 and/or cement shoe 40. Cement 52 is not necessary to the present invention; therefore, it is also contemplated that the first casing string 60 is not cemented into the first wellbore 50 during the operation of the present invention.

Upon placement of the template 100 on the upset portion 36 and the optional cementing of the first casing string 60 into the wellbore 50, the running string 70 is unthreaded from the coupling 65 by any means known to those skilled in the art, including a top drive or a rotary table and tongs. The lugs 115 and 120 act as an anti-rotation device to prevent the first casing string 60 from rotating while the running string 70 rotates, so that the running string 70 rotates relative to the first casing string 60. The running string 70 is removed from the wellbore 25.

The plug 85 may then be threaded onto the coupling 65, as shown in FIG. 4. The plug 85 prevents debris from polluting the first casing string 60 during subsequent operations involving forming the second wellbore 95. The lugs 115 and 120 act as an anti-rotation device while the apparatus for providing torque rotates and threads the plug 85 onto the coupling 65. FIG. 4 shows the plug 85 threadedly connected to the coupling 65. The plug 85 is used in a preferable embodiment of the present invention, but it is also contemplated that the present invention may proceed without use of the plug 85.

Next, referring to FIG. 5, the drill string 90 is inserted into the surface casing 35. The drill string 90, including the cutting structure 91, may be the same as or different from the drill string 55 and cutting structure 56 utilized to drill the first wellbore 50, with respect to diameter of the wellbore which the drill string 90 is capable of drilling as well as other aspects. Preferably, the drill string 90 and cutting structure 91 are configured to directionally drill a deviated second wellbore 95, as described above in relation to the drill string 90 and cutting structure 91. The larger diameter of the second slot 80 relative to the first slot 75 allows the drill string 90 and cutting structure 91 to pass through the second slot 80. As stated above, the first wellbore 50 is drilled prior to the presence of the template 100, so the drill string 55 and cutting structure 56 outer diameters are not limited to the diameter of the first slot 75.

FIG. 5 shows the drill string 90 drilling a second wellbore 90 which is deviated outward relative to the first wellbore 50 at an angle. The second wellbore 90 may be drilled from any portion of the extended wellbore 45 at any angle with respect to vertical. The second wellbore 90 is not required to be deviated at an angle. If desired, the second wellbore 90 may be drilled downward in line with the second slot 80. The drill string 90 is then removed from the second wellbore 95, the extended wellbore 45, and the surface casing 35.

Referring to FIG. 6, the second casing string 105 is placed within the surface casing 35 and through the second slot 80. The funnels 81 and 82 guide and orient the second casing string 105 to place the second casing string 105 into position to enter the second wellbore 95. The second casing string 105 is manipulated to angle into the second wellbore 95. The extended wellbore 45 allows room for manipulation of the orientation of the first casing string 60 and the second casing string 105 when inserting and lowering the first and second casing strings 60 and 105 within their respective wellbores 50 and 95.

Figure 25:
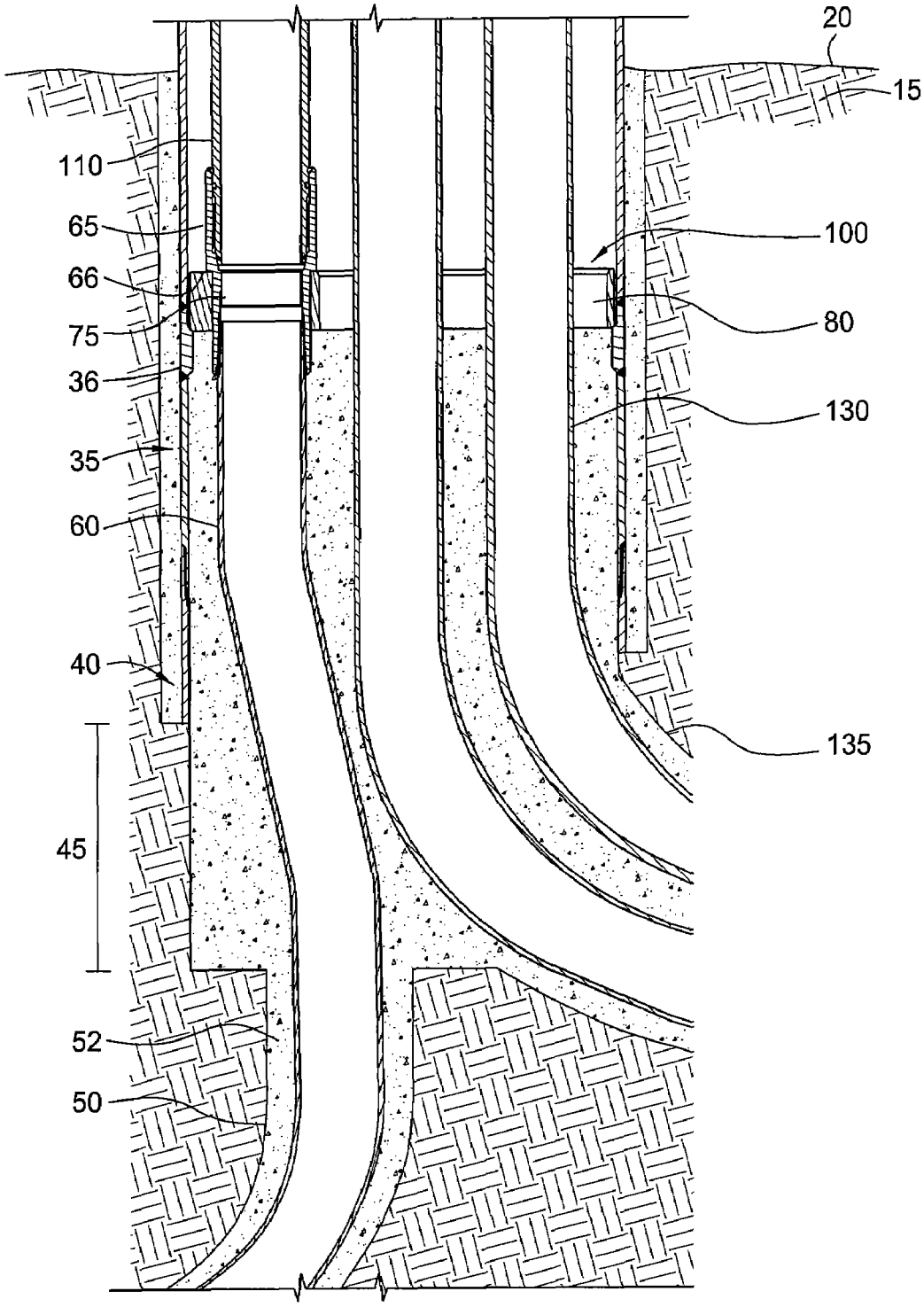
FIG. 25 shows the first casing string disposed within the first wellbore, the second casing string disposed within the second wellbore and a third casing disposed within a third wellbore.

After the second casing string 105 is lowered into the second wellbore 95 to the desired depth, cement 106 may be introduced into the second casing string 105. The cement 106 flows through the second casing string 105, out the lower end (not shown) of the second casing string 105, and up through the annulus between the second casing string 105 and the second wellbore 95. Just as with the first casing string 60 within the first wellbore 50 described above, the cement 106 may alternately only partially fill the annulus between the second casing string 105 and the second wellbore 95, or the cement 106 may be allowed to fill a portion or all of the extended wellbore 45, cement shoe 40, and/or surface casing 35. Cement 106 is not necessary if some other means of suspending the second casing string 105 in place within the second wellbore 95 is utilized. Further, as shown in FIG. 25, a third casing string 130 may be placed in a third wellbore 135 in a similar matter as described herein.

Finally, the plug 85 is removed by unthreading the threadable connection between the lower end of the plug 85 and the upper end of the coupling 65. The casing string 110 is threaded onto the coupling 65 by threadedly connecting the lower end of the casing string 110 to the upper end of the coupling 65. In this manner, the first casing string 60 is "tied back" to the surface 20 by the casing string 110, which allows fluid communication through the first casing string 60 to the surface 20 for subsequent wellbore operations, including hydrocarbon production operations.

FIG. 8 shows the final step in the operation of an embodiment of the present invention. After the first casing string 60 is tied back to the surface 20, sealing elements 61 and 62, preferably packers, and gripping elements 63 and 64, preferably slips, within the dual casing hanger 67 may be activated to grip upper portions of the casing string 110 and the second casing string 105. At this point, the casing strings 60 and 105 are preferably approximately 7.7 inches apart, as measured from the central axis of the first casing string 60 to the central axis of the second casing string 105, and the template 100 is preferably configured to induce this amount of separation. As measured from the center of the dual hanger 67, the distance to the central axis of the second casing string 105 is preferably approximately 3.85 inches. It is contemplated that the first and second casing strings 60 and 105 may be any distance apart from one another, so the present invention is not limited to the above preferable distance measurements. As an alternative to using the dual hanger 67 to hang the casing strings 60 and 105, the casing strings 60 and 105 may be hung by including a coupling with a shoulder of each casing string rather than using the sealing elements 61 and 62 and the gripping elements 63 and 64 to hang the casing strings 60 and 105. Any known method of suspending the casing strings 60 and 105 known to those skilled in the art may be utilized in lieu of the dual casing hanger 67.

The first and/or second wellbores 50 and 95 may then be completed by using packers (not shown) to straddle one or more areas of interest within the formation 15. Perforations are formed through the first and/or second casing strings 60 and 105, the cement 52 and/or 106, and the area of interests within the formation 15. Hydrocarbon production operations may then proceed.

Figure 9:
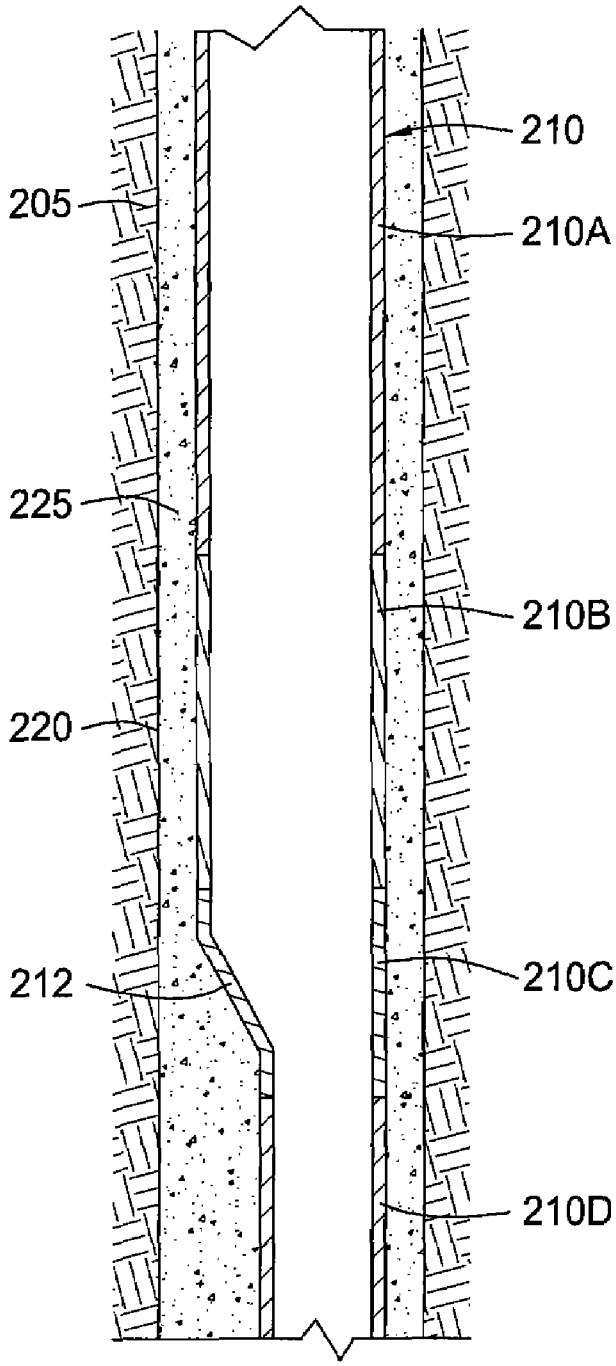
FIG. 9 is a sectional view of surface casing of a second embodiment of the present invention disposed within a wellbore.

A second embodiment of the present invention, shown in FIGS. 9-16, also involves drilling and completing two wellbores below the same wellhead without moving the wellhead. A surface casing 210 is shown in FIG. 9 disposed within a wellbore 220 formed in an earth formation 205. Although the wellhead is not shown, the surface casing 210 extends from the wellhead, and the wellhead is located above the wellbore 220 and within a blowout preventer (not shown). The surface casing 210 is set within the wellbore 220, preferably by a physically alterable bonding material such as cement 225. Cement 225 preferably extends through at least a portion of the annulus between the outer diameter of the surface casing 210 and a wall of the wellbore 220. In the alternative, one or more hanging tools or other hanging mechanisms known to those skilled in the art may be utilized to set the surface casing 210 within the wellbore 220.

The surface casing 210 includes a first casing portion 210A, second casing portion 210B, crossover casing portion 210C, and third casing portion 210D. A float shoe (not shown) having a one-way valve may optionally be located at a lower end of the third casing portion 210D to facilitate cementing of the surface casing 210 within the wellbore 220. Casing portions 210A, 210B, 210C, and 210D are operatively connected to one another, and may be threadedly or otherwise connected to one another. Preferably, the lower end of the first casing portion 210A is connected to the upper end of the second casing portion 210B, the lower end of the second casing portion 210B is connected to the upper end of the crossover casing portion 210C, and the lower end of the crossover casing portion 210C is connected to the upper end of the third casing portion 210D.

The first casing portion 210A has a first inner diameter. Preferably, the first casing portion 210A diameter is approximately 13⅜-inch, with a drift diameter of approximately 12¼ inches and an inner diameter of approximately 12.415 inches, although the first casing portion 210A diameter is not limited to this size. Also, the first casing portion 210A is preferably 1000 feet in length, although the casing portion 210A may extend any length. The second casing portion 210B has an inner diameter which is preferably substantially the same as the first inner diameter. The second casing portion 210B is drillable, preferably constructed of a fiberglass material, to allow drilling of a second wellbore 260 therethrough (see FIG. 13). The fiberglass material also allows communication of signals of logging-while-drilling, measurement-while-drilling, or other steering tools therethrough while drilling a second wellbore 280 (see description of operation below).

The crossover casing portion 210C has an inner diameter at its upper end which is preferably substantially the same as the first inner diameter. After extending at the first inner diameter for a length, one side of the wall of the crossover casing portion 210C angles inward at angled portion 212 so that the crossover casing portion 210C eventually becomes a second, smaller inner diameter and extends at this second inner diameter for a length to form a leg from the surface casing 210. Therefore, the crossover casing portion 210C forms an off-centered crossover, where the centerline of the maximum inner diameter portion of the surface casing 210 is not coaxial with the centerline of the minimum inner diameter portion of the surface casing 210. The third casing portion 210D extends from the lower end of the crossover portion 210C and has an inner diameter substantially the same as the second inner diameter. The third casing portion 210D, although not limited to this size, is preferably 8⅝-inches in diameter.

Figure 10:
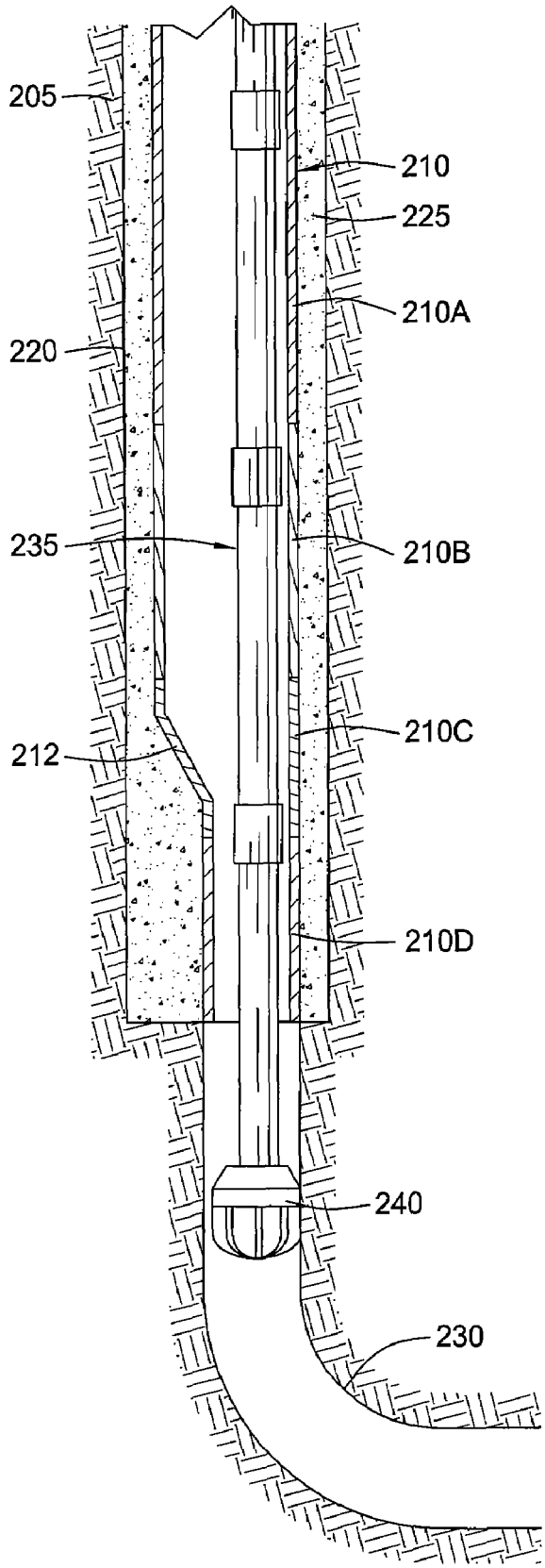
FIG. 10 shows a first wellbore drilled below the surface casing of FIG. 9.

FIG. 10 shows a first wellbore 230 extending from the wellbore 220. The first wellbore 230 is preferably a hole of 7⅞-inches in diameter drilled into the earth formation 205, but the hole may be of any diameter. As shown, the first wellbore 230 extends in a direction away from the centerline of the third casing portion 210D. It is also within the scope of the present invention that the first wellbore 230 may extend substantially vertically or at any other trajectory away from the centerline of the third casing portion 210D.

Also shown in FIG. 10 is a drill string 235 capable of forming the first wellbore 230 within the formation 205 by drilling into the earth formation 205. The drill string 235 includes generally a running tool connected to a drill bit 240, wherein the drill bit 240 includes any earth removal member known to those skilled in the art. One or more measurement devices may be located on the drill string to allow determination and optimization of the orientation and trajectory of the drill string 235 within the formation 205 while drilling, including any logging-while-drilling tools or measuring-while-drilling tools, or any other steering tools known to those skilled in the art.

Figure 11:
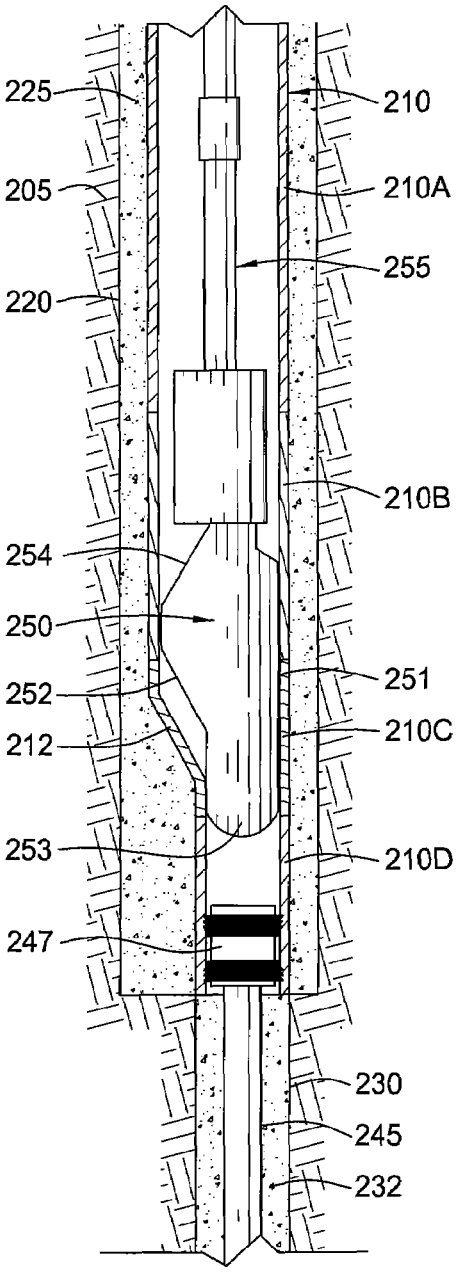
FIG. 11 shows a first casing disposed within the first wellbore and a diverting tool being lowered into the surface casing of FIG. 9.

Additional components are shown in FIG. 11. A running string 255 capable of conveying a diverting tool 250 into the wellbore 220 is shown operatively connected to the diverting tool 250. The diverting tool 250 is capable of diverting or guiding a mechanism or tubular body at an angle from the centerline of the first inner diameter portion of the surface casing 210.

Preferably a whipstock, the diverting tool 250 is specially shaped to conform with the shape of the crossover casing portion 210C of the surface casing 210 and to prevent rotation of the diverting tool 250 relative to the surface casing 210. The angled portion 212 of the inner diameter of the surface casing 210 in which the surface casing 210 changes from the first inner diameter to the smaller, second inner diameter and the angled portion 252 of the diverting tool 250 have substantially the same slopes to mate with one another when the diverting tool 250 rests on the angled portion 212. Additionally, the side 251 of the diverting tool 250 opposite the angled portion 212 is essentially longitudinal to conform with the generally longitudinally disposed inner wall of that side of the surface casing 210 inner diameter.

Figure 12:
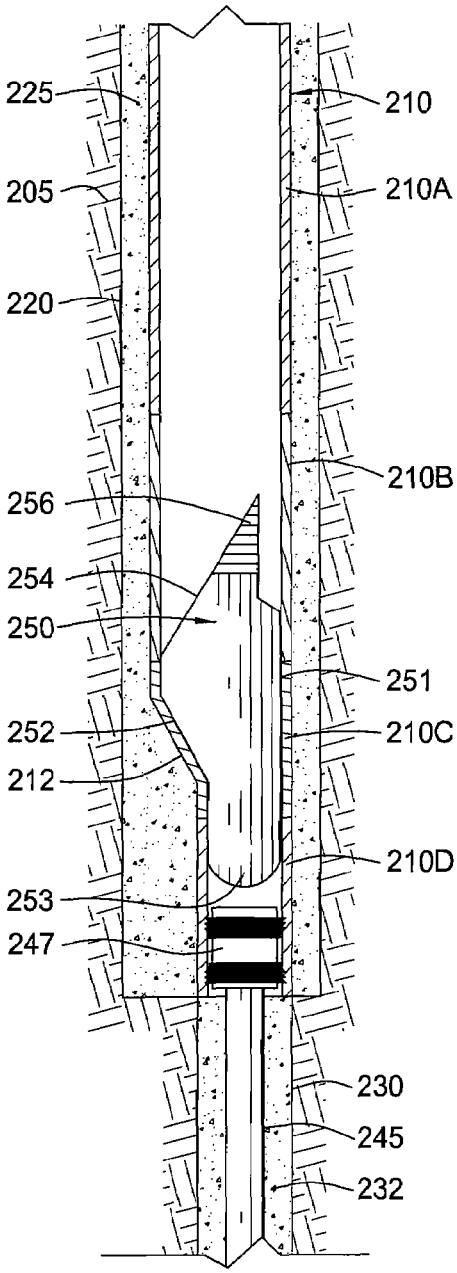
FIG. 12 shows the diverting tool located within the surface casing of FIG. 9.

An extending end 253 of the diverting tool 250 is generally tubular-shaped and of an outer diameter substantially the same as the second inner diameter of the surface casing 210 to allow the extending end 253 to fit within the portion of the surface casing 210 having the second inner diameter, as shown in FIG. 12. Referring now to FIG. 12, a diverting surface 254 of the diverting tool 250 is angled downward toward the inner diameter of the surface casing 210 at an angle substantially opposite from the angle of the angled portion 252. The diverting surface 254 is used to divert one or more mechanisms or tubular bodies at an angle from the surface casing 210. Threads 256 may be located at an upper end of the diverting surface 254 for mating with opposing threads (not shown) of the running string 255 so that the running string 255 may convey the diverting tool 250 into the wellbore 220 (see FIG. 11). Any other connecting means known to those skilled in the art may be utilized to connect the diverting tool 250 to the running string 255, and any type of running tool known to those skilled in the art may be utilized as the running string 255.

As shown in both FIGS. 11 and 12, a first casing 245 is located within the first wellbore 230 and may be at least partially cemented therein using cement 232 or another physically alterable bonding material within the annulus between the outer diameter of the first casing 245 and the wall of the first wellbore 230. A float shoe (not shown) having a one-way valve may optionally be located at a lower end of the first casing 245 to facilitate cementing.

A hanging mechanism such as a liner hanger 247 may be utilized to initially hang the first casing 245 within the first wellbore 230 prior to cementing. In the alternative, the liner hanger 247 may be utilized to hang the first casing 245 within the first wellbore 230 in lieu of cementing. The liner hanger 247 is shown hanging the first casing 245 by engaging the inner diameter of the third casing portion 210D of the surface casing 210, but the liner hanger 247 may also be used to hang the first casing 245 from the wall of the first wellbore 230.

Figure 13:
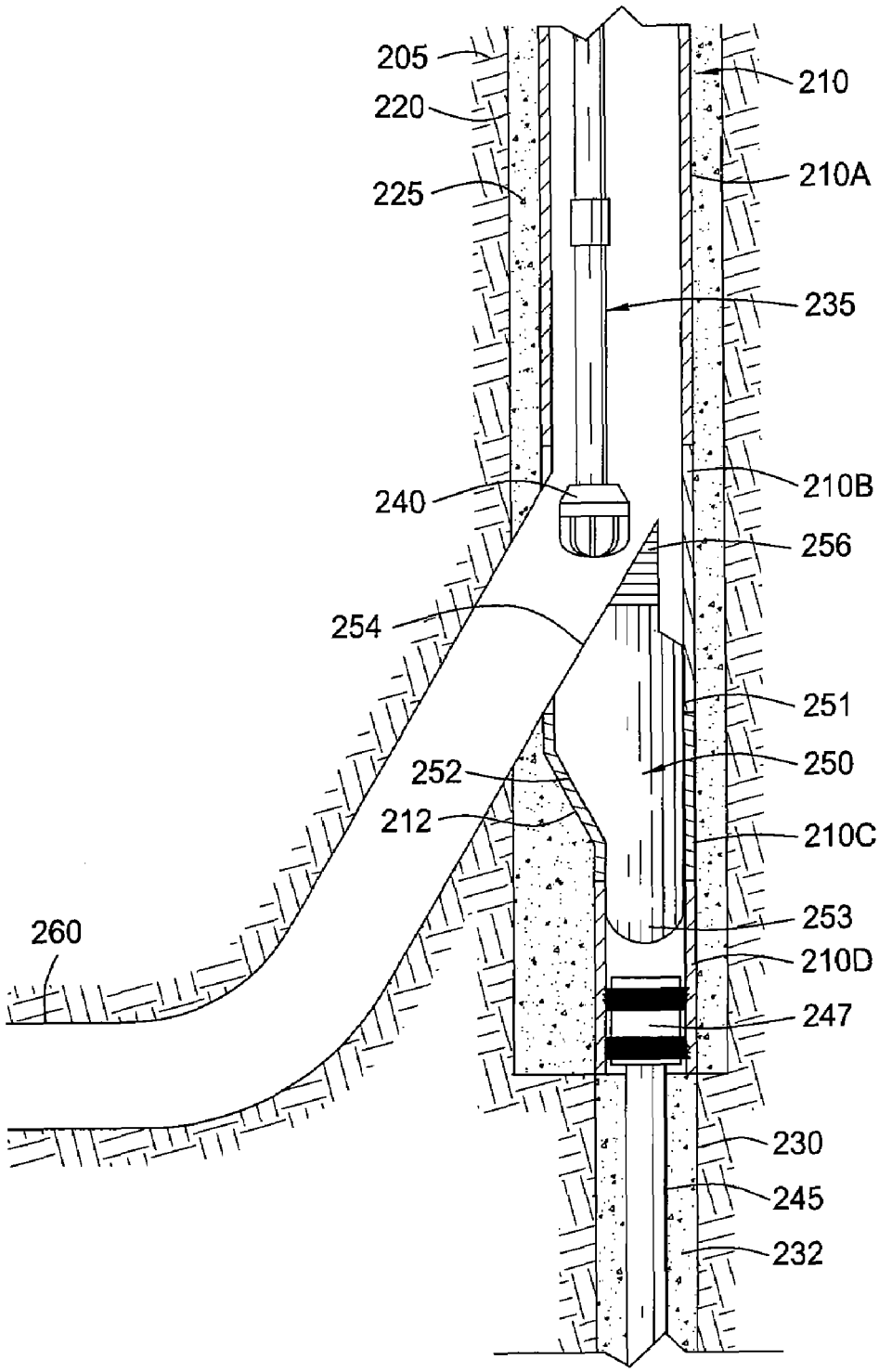
FIG. 13 shows a second wellbore drilled from the surface casing of FIG. 9.

FIG. 13 shows a second wellbore 260 extending from the surface casing 210. The drill string 235 may be utilized to drill the second wellbore 260. The second wellbore 260 is shown deviating at an angle away from the centerline of the surface casing 210, but may extend vertically therefrom or at any other angle away from vertical.

Figure 15:
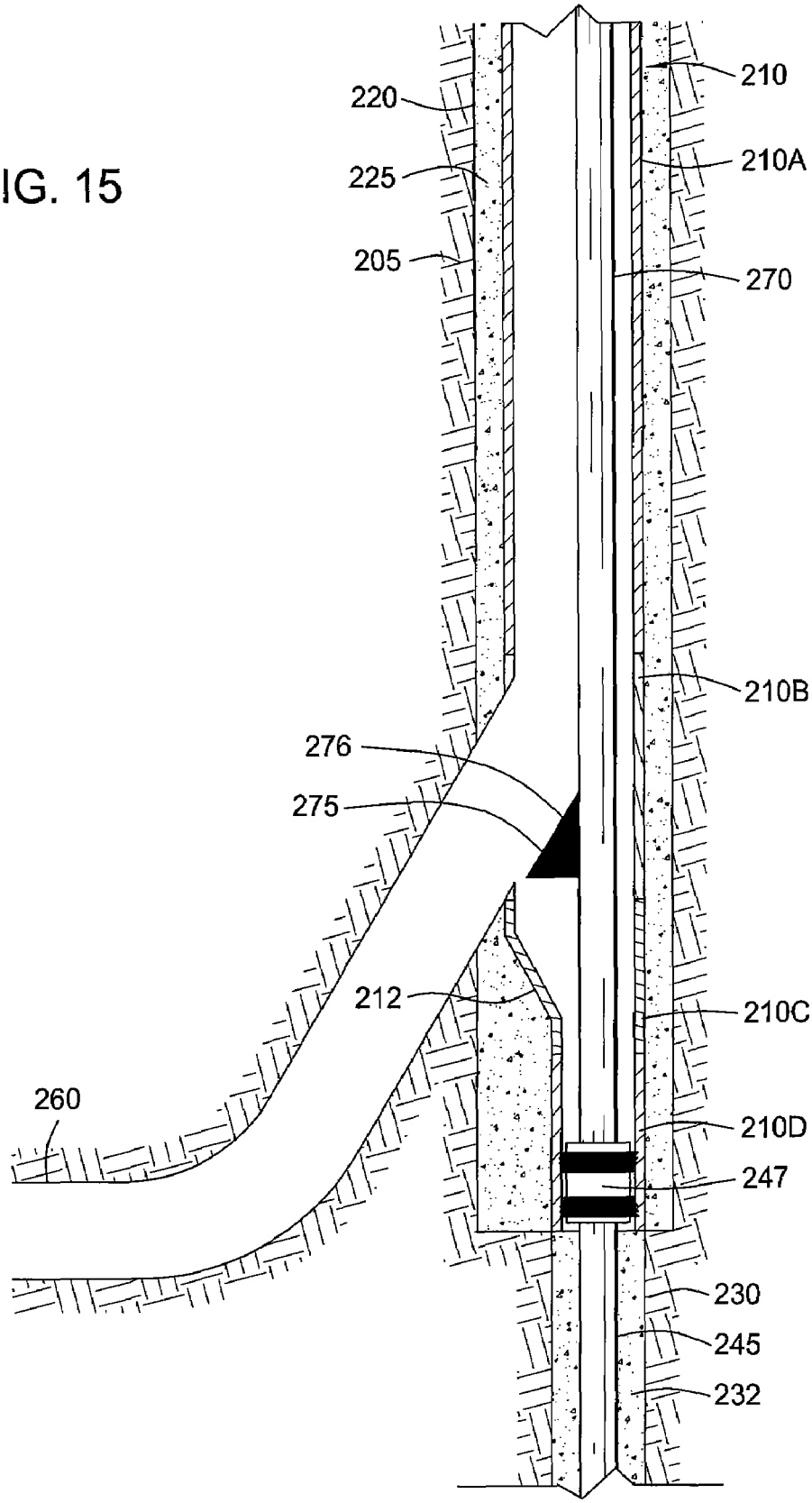
FIG. 15 shows a tie-back casing operatively connected to the upper end of the first casing.
Figure 16:
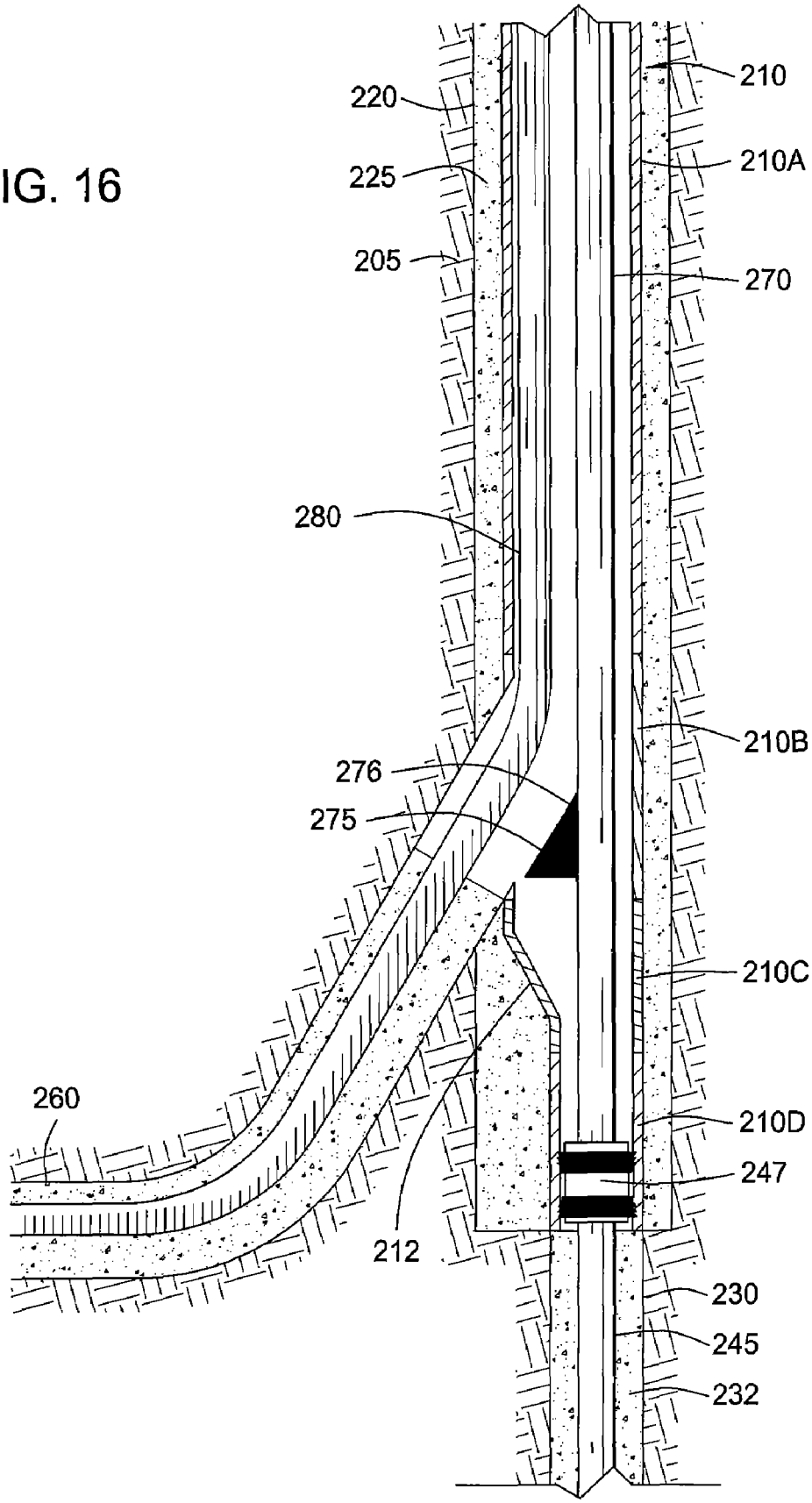
FIG. 16 shows a second casing disposed within the second wellbore.

Referring now to FIG. 15, a lower end of tie-back casing 270 is operatively connected to an upper end of the first casing 245, possibly through the liner hanger 247. The tie-back casing 270 is preferably 4½ inch diameter liner, but may be of any size. Proximate to the juncture between the surface casing 210 and the second wellbore 260, a deflector 275 extends from an outer diameter of the side of the casing 270 closest to the second wellbore 260. The deflector 275 has an angled deflecting surface 276 for deflecting any mechanisms, tools, or tubulars desired for placement within the second wellbore 260 from the surface casing 210. Specifically, the deflecting surface 276 may be capable of deflecting a second casing 280 into the second wellbore 260, as shown in FIG. 16.

Figure 22:
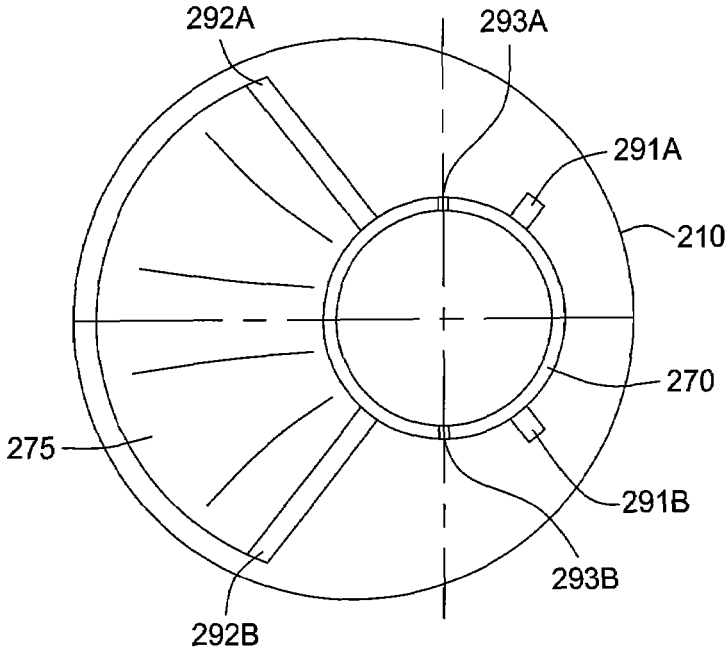
FIG. 22 is a cross-sectional view of an embodiment of the tie-back casing of FIG. 15 disposed within the surface casing.
Figure 23:
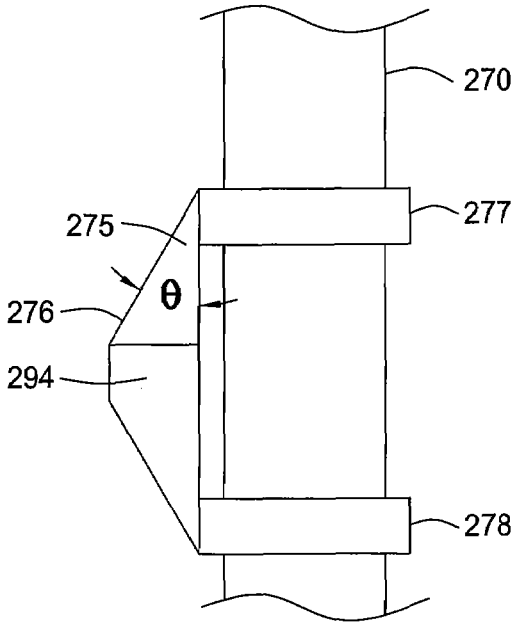
FIG. 23 is a sectional view of an embodiment of the tie-back casing of FIG. 15 having a deflector disposed thereon.

FIG. 23 is a section view of an embodiment of the portion of the tie-back casing 270 having the deflector 275 thereon. The deflector 275 is operatively attached to the tie-back casing 270. FIG. 23 shows one method of attaching the deflector 275 to the tie-back casing 270 using one or more clamping mechanisms 277, 278. The clamping mechanisms 277, 278 secure the deflector 275 to the tie-back casing 270 as well as establish the rotational and axial position of the deflector 275 relative to the tie-back casing 270. The clamping mechanisms 277, 278 are preferably fixed onto the tie-back casing 270 with set screws 293A, 293B (shown in FIG. 22, which is described below) and most preferably are approximately 4 inches wide.

A support member such as a support gusset 294 preferably extends below the deflector 275 to provide additional mechanical strength to the deflector 275. Preferably, the maximum width of the deflector 275 is approximately the same as the maximum width of the support gusset 294, and most preferably this width is 5 inches. The deflecting surface 276 of the deflector member 275 is preferably 10 inches long, and the angle Θ at which the deflecting surface 276 extends from the outer length of the tie-back casing 270 is approximately 30 degrees.

Figure 24:
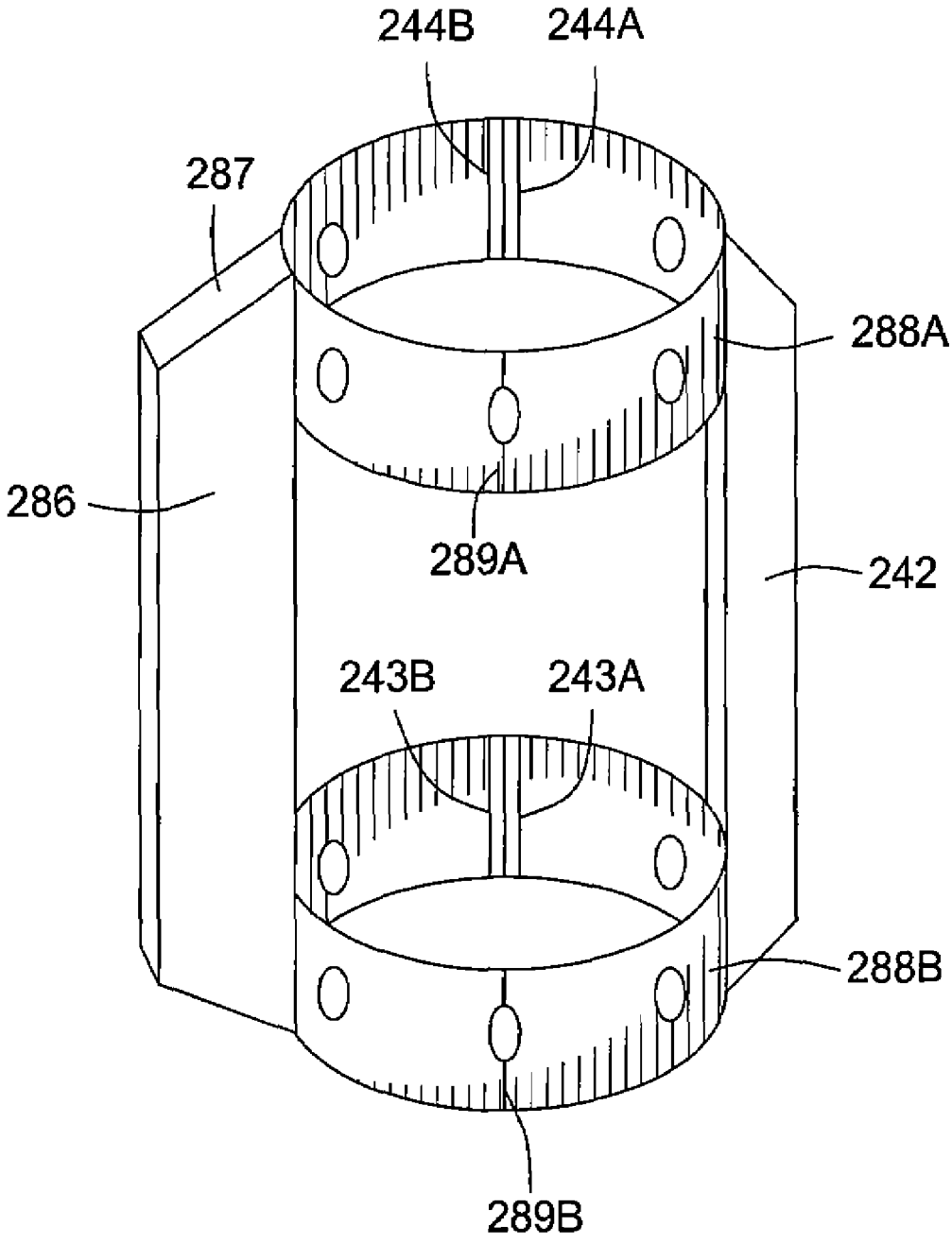
FIG. 24 shows an embodiment of a deflector usable with the tie-back casing of FIG. 15.

FIG. 24 shows an alternate embodiment of a deflecting mechanism usable as the deflector 275. In this embodiment, a stop collar is placed around the tie-back casing 270. The stop collar includes one or more collars 288A, 288B connected to one another by a longitudinally disposed deflector 286 and a longitudinally disposed blade 242. The deflector 286 and the blade 242 are preferably substantially parallel to one another and disposed approximately 180 degrees apart from one another on an outer diameter of the collars 288A, 288B. The collars 288A, 288B each include hinges 289A, 289B which allow the collars 288A, 288B to open so that ends 244A and 244B and ends 243A and 243B move away from one another, thereby permitting placement of the stop collar on the tie-back casing 270. Hinges 289A, 289B also allow the collars 288A, 288B to close so that ends 244A, 244B and 243A, 243B contact one another and the stop collar may be securely placed around the tie-back casing 270.

The deflector 286 extends in the direction of the second wellbore 260, while the blade 242 extends in the opposite direction towards the inner diameter of the surface casing 210. The blade 242 and the deflector 286 generally operate as a centralizer for the tie-back casing 270. Although any width is within the scope of embodiments of the present invention, the deflector 286 most preferably has a maximum width (measured perpendicular from the outer diameter of the tie-back casing 270) of approximately 5 inches, while most preferably the blade 242 has a maximum width of approximately 1½ inches. Most preferably, the thickness (measured generally parallel to the outer diameter of the tie-back casing 270) of the blade 242 as well as the deflector 286 is approximately 1 inch, although any thickness is in the scope of embodiments of the present invention.

At the upper and lower ends, the blade 242 is preferably angled to slope downward at the upper end and upward at the lower end. The lower end of the deflector 286 is also preferably angled to slope upward, as shown in FIG. 24. The upper end of the deflector 286 is sloped downward in the direction of the second wellbore 260 to provide a deflecting surface 287 for guiding the second casing 280 into the second wellbore 260. Most preferably, the deflecting surface 287 and the lower end of the deflector 286 are angled approximately 30 degrees with respect to the outer diameter of the collars 288A, 288B. The deflecting surface 287 is preferably concave (the concave deflecting surface may be formed using the inside, concave surface of a tubular) to prevent the second casing 280 from falling from the deflecting surface 287 while it is being manipulated into the second wellbore 260.

FIG. 16 shows the second casing 280 disposed within the second wellbore 260. The second casing 280 may optionally be set within the second wellbore 260 by a physically alterable bonding material at least partially disposed within the annulus between the outer diameter of the second casing 280 and the wall of the second wellbore 260, or instead may be hung within the second wellbore 260 by any other hanging mechanism known to those skilled in the art. A float shoe (not shown) having a one-way valve may optionally be located at a lower end of the second casing 280 to facilitate cementing.

In operation, the surface casing portions 210A, 210B, 210C, and 210D are operatively connected to one another, and the wellbore 220 is formed in the earth formation 205 using an earth removal member (not shown) such as a drill bit operatively connected to a drill string (not shown). The surface casing 210 is lowered into the wellbore 220 and set within the wellbore 220, preferably by introducing cement 225 into at least a portion of the annulus, as shown in FIG. 9. To flow cement 225 into the annulus between the outer diameter of the surface casing 210 and the wall of the wellbore 220, cement 225 is introduced into an inner diameter of the surface casing 210, then the cement 225 flows out the lower end of the surface casing 210 (possibly out the float shoe) and up into the annulus. Instead of using cement 225, any casing-hanging mechanism known to those skilled in the art may be utilized to set the surface casing 210 within the wellbore 220.

FIG. 9 depicts the surface casing 210 set within the wellbore 220. As shown in FIG. 9, the crossover casing portion 210C is positioned within the wellbore so that the angled portion 212 is oriented in the direction in which it is desired to form the second wellbore 260 (see FIG. 13).

After the surface casing 210 is set within the wellbore 220, the drill string 235 (see FIG. 10) is lowered into an inner diameter of the surface casing 210. The drill string 235, including the drill bit 240, is smaller in outer diameter than the drill string (not shown) used to form the wellbore 220 so that the drill string 235 fits within the inner diameter of the surface casing 210. The drill string 235, including the drill bit 240, is also smaller in outer diameter than the inner diameter of the third casing portion 210D to allow the drill string 235 to fit through the third casing portion 210D and drill a first wellbore 230 therebelow.

The drill string 235 is lowered into the inner diameter of the third casing portion 210D and out through the lower end of the third casing portion 210D to drill the first wellbore 230 within the formation 205 using the drill bit 240. The angled portion 212 acts to guide the drill string 235 into the second, minimum inner diameter portion of the crossover casing portion 210C. The third casing portion 210D and the second inner diameter portion of the crossover casing portion 210C act to guide the drill string 235 into the portion of the formation 205 in which the first wellbore 230 is desired to be formed.

The drill bit 240 forms the first wellbore 230 below the surface casing 210 as shown in FIG. 10. The trajectory of the first wellbore 230 may be altered by manipulating the direction and angle of the drill string 235 within the formation 205. The direction in which the angle of the drill string 235 should be manipulated may be communicated by one or more logging-while-drilling or measuring-while drilling tools or any other steering tool known by those skilled in the art. Preferably, the first wellbore 230 is deviated in the opposite direction from the angled portion 212, as shown in FIG. 10, to avoid co-mingling of the first and second wellbores 230, 260 (see FIG. 13). However, it is also within the scope of embodiments of the present invention to form the first wellbore 230 substantially co-axial to the third casing portion 210D along its entire length, or to form the first wellbore 230 at any angle with respect to the centerline of the third casing portion 210D.

After the first wellbore 230 is formed, the drill string 235 is removed from the surface casing 210. FIG. 10 shows the drill string 235 being removed from the surface casing 210.

Referring to FIG. 11, the first casing 245 is lowered into the inner diameter of the surface casing 210. The angled portion 212 acts as a guide for the first casing 245 into the second inner diameter portion of the crossover casing portion 210C. The liner hanger 247 is used in the conventional manner to hang the first casing 245 from the lower end of the surface casing 210. After running the first casing 245 into the first wellbore 230, the first casing 245 may optionally be cemented therein by flowing cement 232 into the inner diameter of the surface casing 210. The cement 232 then flows through the inner diameter of the first casing 245, out the lower end of the first casing 245 (and possibly out through the float shoe), and into an annulus between the outer diameter of the first casing 245 and the wall of the first wellbore 230. Cement 232 may partially or completely fill the annulus.

After cementing the first casing 245 within the first wellbore 230, a plug (not shown) may be run into the inner diameter of the first casing 245 to prevent debris from entering the first casing 245 when subsequently forming the second wellbore 260. The plug may be any mechanism capable of obstructing access from the portion of the inner diameter of the first casing 245 above the plug to the portion of the inner diameter of the first casing 245 below the plug. For example, the plug may be a bridge plug or a plug set in a nipple known by those skilled in the art. The diverting tool 250 is then lowered into the inner diameter of the surface casing 210 using a running string 255 (or any other running tool known by those skilled in the art).

To orient the diverting tool 250 correctly within the surface casing 210, the diverting tool 250 is positioned with respect to the surface casing 210 prior to entering the surface casing 210 so that the angled portion 252 of the diverting tool 250 is oriented directly in line with the angled portion 212 of the crossover casing portion 210C. If the position of the angled portion 212 within the wellbore 220 is unknown, the diverting tool 250 may be lowered with the angled portion 252 at a given rotational position. If the orientation of the diverting tool 250 is incorrect at this rotational position, the diverting tool 250 will not attain a deep enough depth within the surface casing 210. If the diverting tool 250 is in the wrong position for the extending end 253 to enter the crossover casing portion 210C, the running string 255 will not lower to a sufficient depth, so that the running string 255 may be lifted and the diverting tool 250 re-oriented within the surface casing 210. Thus, a trial-and-error process may be utilized when orienting the diverting tool 250 with respect to the surface casing 210. FIG. 11 shows the diverting tool 250 being lowered into the surface casing 210, where the angled portion 252 of the diverting tool 250 is directly in line with the angled portion 212 of the crossover casing portion 210C.

In an alternate embodiment, a geometrically-shaped object having a profile (such as a square profile) may be located between the maximum and minimum inner diameter portions of the surface casing 210, or within the leg. A matching profile (such as a square profile) is then disposed on a side of the diverting tool 250. In this embodiment, the extending end 253 of the diverting tool 250 is not necessary to prevent rotation of the diverting tool 250 relative to the surface casing 210. The profile of the diverting tool 250 and the profile of the geometrically-shaped object mate with one another to prevent rotation of the diverting tool 250 relative to the surface casing 210 and to allow proper orientation of the diverting tool 250 within the surface casing 210. The mating profiles may be splines on the diverting tool 250 which match splines on the geometrically-shaped object in lieu of matching square profiles. Also in this embodiment, if the diverting tool 250 does not reach a sufficient depth within the surface casing 210, the profiles must not be matching at that rotational position of the diverting tool 250, so the diverting tool 250 is lifted and re-oriented. This process may be repeated any number of times until the diverting tool 250 reaches a sufficient depth within the surface casing 210.

The diverting tool 250 is ultimately positioned on the crossover casing portion 210C as illustrated in FIG. 12. The angled portion 252 of the diverting tool 250 is in contact with the angled portion 212 of the crossover casing portion 210C, and the extending end 253 of the diverting tool 250 fits into the inner diameter of the smallest diameter portion of the crossover casing portion 210C and the third casing portion 210D. Preferably, when the diverting tool 250 is in position within the surface casing 210 for forming the second wellbore 260, the second casing portion 210B is substantially adjacent to the diverting surface 254 of the diverting tool 250. The diverting tool 250 is prevented from rotational movement relative to the surface casing 210 because the extending end 253 locks the diverting tool 250 into radial position, and the angled diverting surface 254 and angled portion 252 are too large in outer diameter to rotate around the side of the surface casing 210 having the leg extending therefrom while the extending end 253 remains in the leg.

After the diverting tool 250 is positioned within the crossover casing portion 210C as shown in FIG. 12, the running string 255 is removed from the surface casing 210, preferably by unthreading the running string 255 from the threads 256 of the diverting tool 250 and lifting the running string 255 from the surface casing 210. FIG. 12 shows the diverting tool 250 in position for diverting a tool in the general direction of the downward slope of the diverting surface 254 using the diverting surface 254 as a guide for the tool.

Next, referring to FIG. 13, the drill string 235 having the drill bit 240 operatively connected thereto is lowered into the inner diameter of the surface casing 210. Once the drill bit 240 reaches the diverting surface 254 of the diverting tool 250, the drill bit 240 cannot travel directly downward anymore and is guided over the diverting surface 254 into the inner diameter of the side of the second casing portion 210B above the lower end of the diverting surface 254 of the diverting tool 250. The drill bit 240 then drills through at least a portion of the second casing portion 210B, through the cement 225 surrounding the second casing portion 210B, and into the formation 205 to form the second wellbore 260. Because the diverting surface 254 is used as a guide for the angle in which the second wellbore 260 will be drilled, the diverting tool 250 is preferably formed to produce the desired second wellbore 260 trajectory by providing a given slope along the diverting surface 254 prior to its insertion into the wellbore 220. The second wellbore 260 may be directionally drilled to alter or maintain the trajectory of the second wellbore 260 using one or more logging-while-drilling or measuring-while-drilling tools, or any other steering tool known to those skilled in the art, as described above in relation to drilling the first wellbore 230.

After drilling the second wellbore 260, the drill string 235 is removed from the second wellbore 260 and from the wellbore 220. FIG. 13 shows the drill string 235 being removed from wellbore 220.

Figure 14:
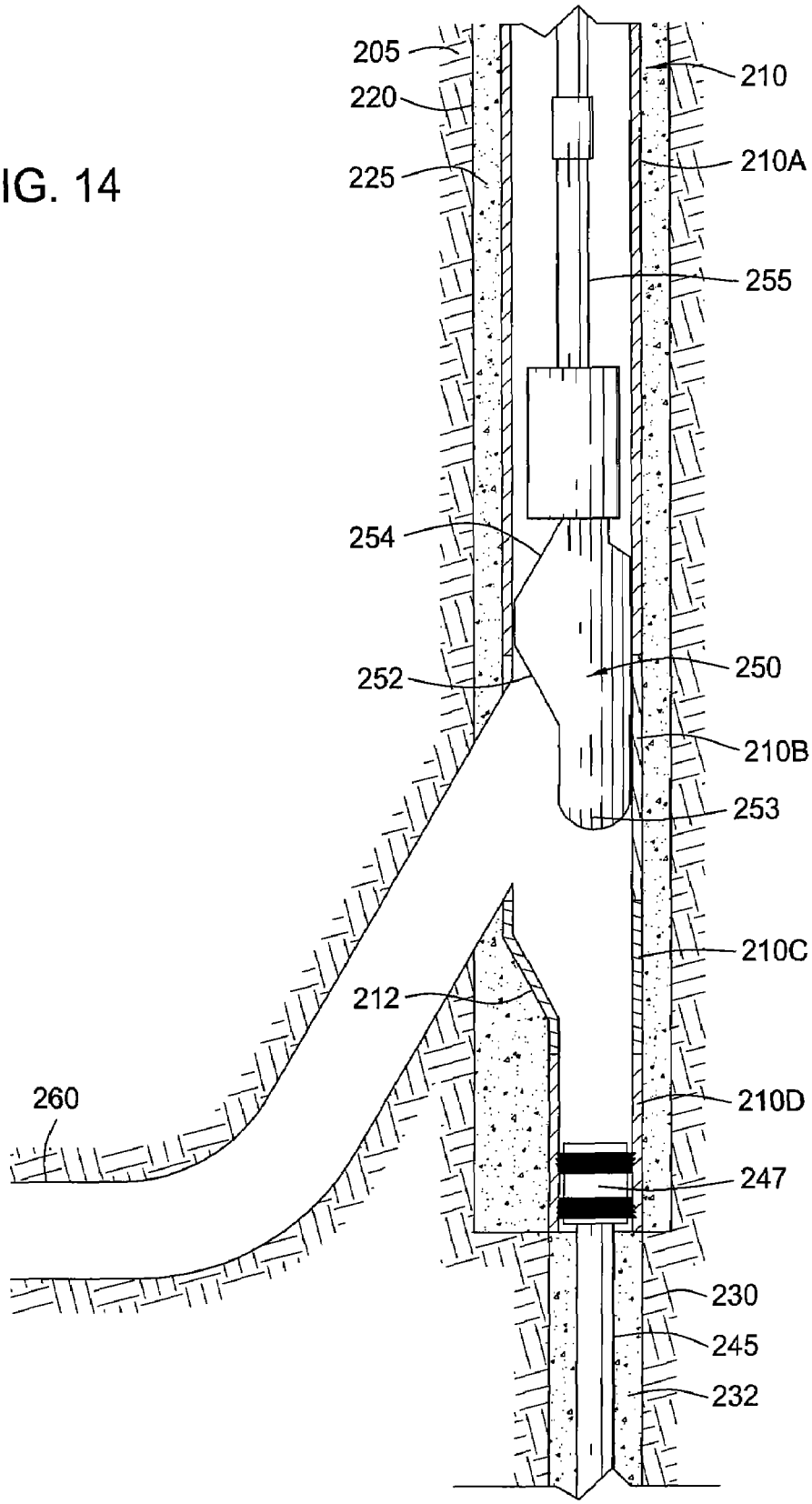
FIG. 14 shows the diverting tool being retrieved from the surface casing of FIG. 9.

Subsequent to removing the drill string 235 from the wellbore 220, the running string 255 is lowered into the surface casing 210 and operatively connected to the diverting tool 250, preferably by a threaded connection. The running string 255 is then lifted to remove the diverting tool 250 from the wellbore 220. FIG. 14 shows the running string 255 used to lift the diverting tool 250 from the wellbore 220.

The tie-back casing 270 used to tie the first casing 245 back to up to the surface of the wellbore 220 is then lowered into the inner diameter of the surface casing 210. A lower end of the tie-back casing 270 is operatively connected to an upper end of the first casing 245, preferably by a threaded connection. The deflector 275 is oriented in line with the second wellbore 260. The slope of the deflecting surface of the deflector 275 is preferably substantially similar to the slope of the deflecting surface 254 of the diverting tool 250 to allow tools to be diverted by the deflector 275 into the same wellbore which was drilled using the deflecting surface 254. The location of the deflector 275 on the tie-back casing 270 may be pre-determined prior to the location of the tie-back casing 270 into the wellbore 220 to allow the deflector 275 to act as an extension to the second wellbore 260, or this location may be attained by placing the deflector 275 on the tie-back casing 270 after the tie-back casing 270 is already located downhole.

The second casing 280 is then lowered into the inner diameter of the surface casing 210 (see FIG. 16) between the outer diameter of the tie-back casing 270 and the inner diameter of the surface casing 210 generally in line with the hole from the surface casing 210 leading to the second wellbore 260. The deflector 275 guides the second casing 280 into the second wellbore 260. Optionally, cement 283 may be introduced into the inner diameter of the second casing 280, out the lower end of the second casing 280 (and possible the float shoe), and into the annulus between the outer diameter of the second casing 280 and the wall of the second wellbore 260 to set the second casing 280 within the second wellbore 260. Cement 283 may partially or completely fill the annulus. In the alternative, a hanging tool may be utilized to set the second casing 280 within the second wellbore 260. After setting the second casing 280 within the second wellbore 260, the plug is retrieved from the inner diameter of the first casing 245 through the tie-back casing 270.

FIG. 16 shows the resulting multi-lateral wellbore consistent with embodiments of the present invention. By the method described above using apparatuses as described above, two independent cased wellbores 260 and 280 are formed from one drilled wellbore 220 from the surface without moving the wellhead disposed above the wellbore 220. As viewed from the surface, the wellbore 220 has only one casing 210 therein; however, as depth of the wellbore 220 increases, the wellbore 220 branches into two independently-producing, completed wells.

FIGS. 17-21 depict a third embodiment of the present invention. In this embodiment, the surface casing 310 is substantially the same as the surface casing 210. The difference between the surface casings 210 and 310 is that the surface casing 310 includes a built-in deflector member 307 extending from the inner diameter of the crossover casing portion 310C of the surface casing 310 below the second casing portion 310B on the wall of the surface casing 310 through which the second wellbore 360 is drilled. Therefore, a deflector is integral with the off-centered crossover casing portion, thus eliminating the need for a deflector on the tie-back casing, as is present in the embodiments of FIGS. 17-21.

Figure 17:
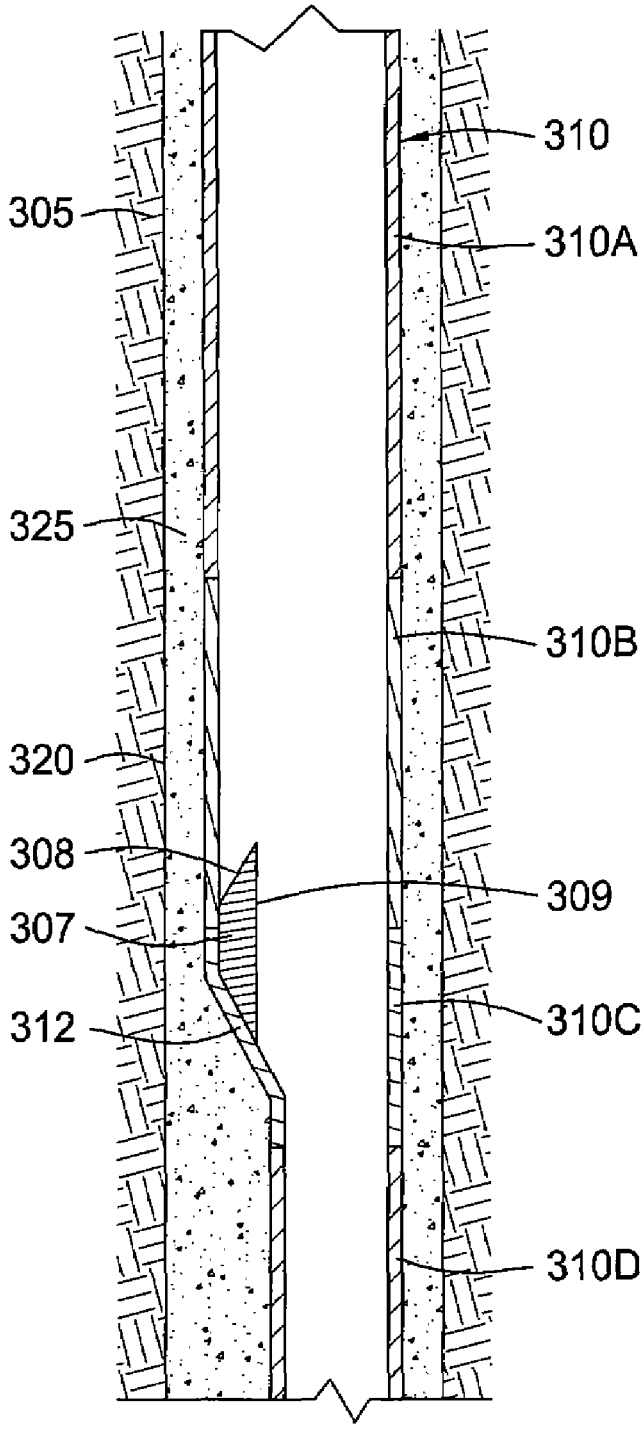
FIG. 17 is a sectional view of surface casing of a third embodiment of the present invention disposed within a wellbore.
Figure 20:
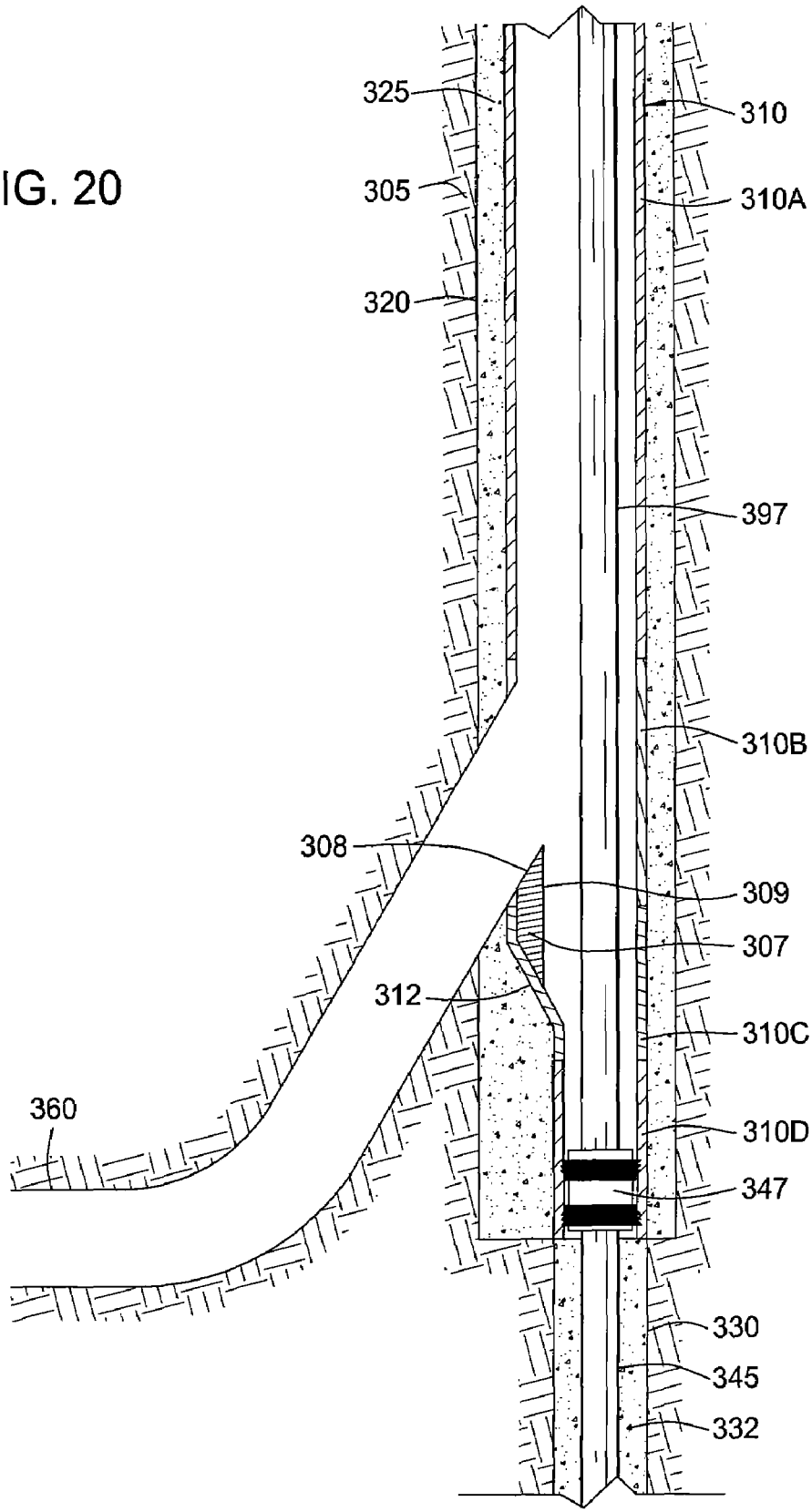
FIG. 20 shows a tie-back casing operatively connected to the upper end of the first casing and a second wellbore drilled from the surface casing of FIG. 17.

Referring generally to FIG. 17, the deflector member 307 has a deflecting surface 308 angled downward in the direction in which the second wellbore 360 is to be deflected (see FIG. 20). The deflector member 307 includes a substantially longitudinal, flat outer surface 309.

Figure 18:
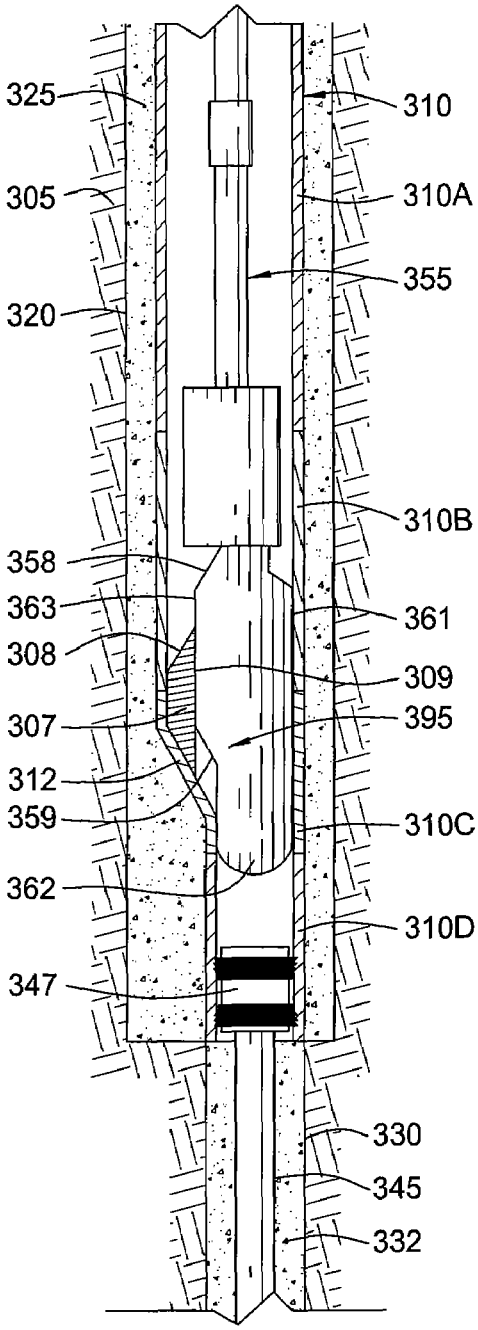
FIG. 18 shows a first wellbore drilled below the surface casing of FIG. 17 and a first casing disposed within the first wellbore. A diverting tool is being lowered into the surface casing.
Figure 19:
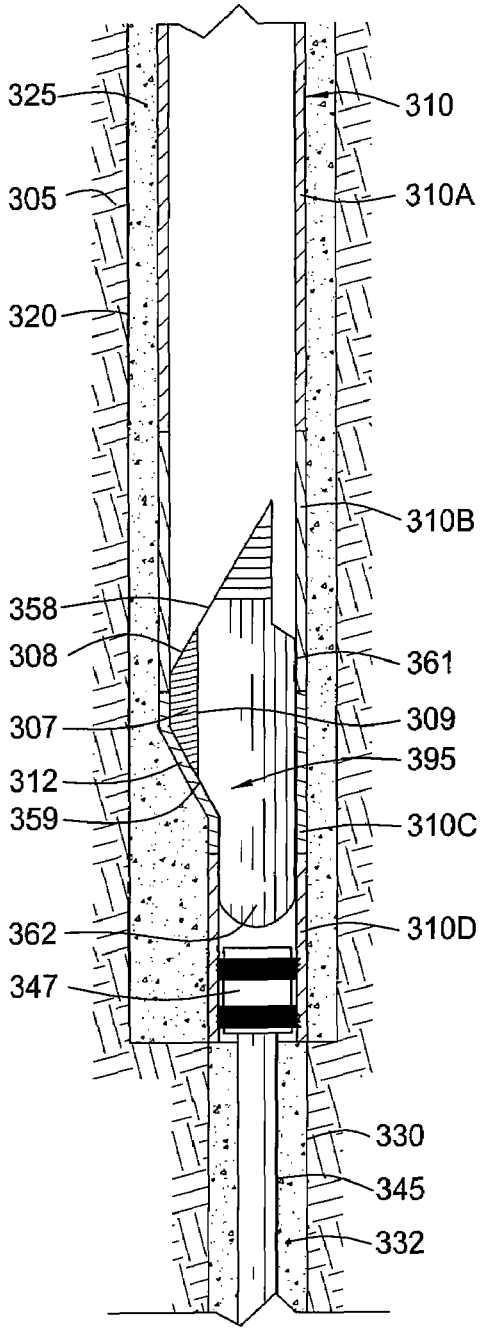
FIG. 19 shows the diverting tool located within the surface casing of FIG. 17.

A diverting tool 395, shown in FIGS. 18 and 19, is essentially shaped the same as the diverting tool 250, except that the diverting tool 395 has a smaller maximum width than the diverting tool 250, the maximum width of the diverting tool 395 measured from a first side 363 to a second side 361. A deflecting surface 358 of the diverting tool 395 is shorter than the deflecting surface 250 because of the reduced width of the diverting tool 395. The reduced width of the diverting tool causes space to exist between the inner diameter of the surface casing 310 and the outer diameter of the diverting tool 395, which space is filled with the deflector member 307 when the diverting tool 395 reaches a position within the crossover casing portion 310C (see FIG. 19). In this manner, the diverting tool 395 and deflector member 307 mate to form a unified deflecting surface for deflecting one or more tools and/or tubulars in the direction of the second wellbore 360.

In one embodiment, the outer surface 309 of the deflector member 307 is concave to receive the rounded first side 363 of the diverting tool 395. In another embodiment, the outer surface 309 of the deflector member 307 is flat, and the outer surface of the first side 363 of the diverting tool 395 is sliced off and flat (not tubular-shaped). In yet another embodiment, the first side 363 of the diverting tool 395 and the outer surface 309 of the adjacent side of the deflector member 307 include mating profiles, such as mating geometric shapes (e.g., square profiles) or mating splines. When the outer surface 309 of the adjacent side of the deflector member 307 and the first side 363 of the diverting tool 395 are flat or have mating profiles, the extending end 362 is not necessary to prevent rotation of the diverting tool 395 relative to the surface casing 310, as the mating profiles or flat surfaces prevent rotation of the diverting tool 395 relative to the surface casing 310. The flat surfaces or mating profiles further allow orientation within the surface casing 310 of the diverting tool 395. If the diverting tool 395 is prevented from lowering to a sufficient depth within the surface casing 310 because the profiles are not correctly aligned with one another, the diverting tool 395 is lifted, re-oriented relative to the surface casing 310, and again lowered into the surface casing 310. This process may be repeated any number of times to fit the profile of the diverting tool 395 into the profile of the deflector member 307.

Figure 21:
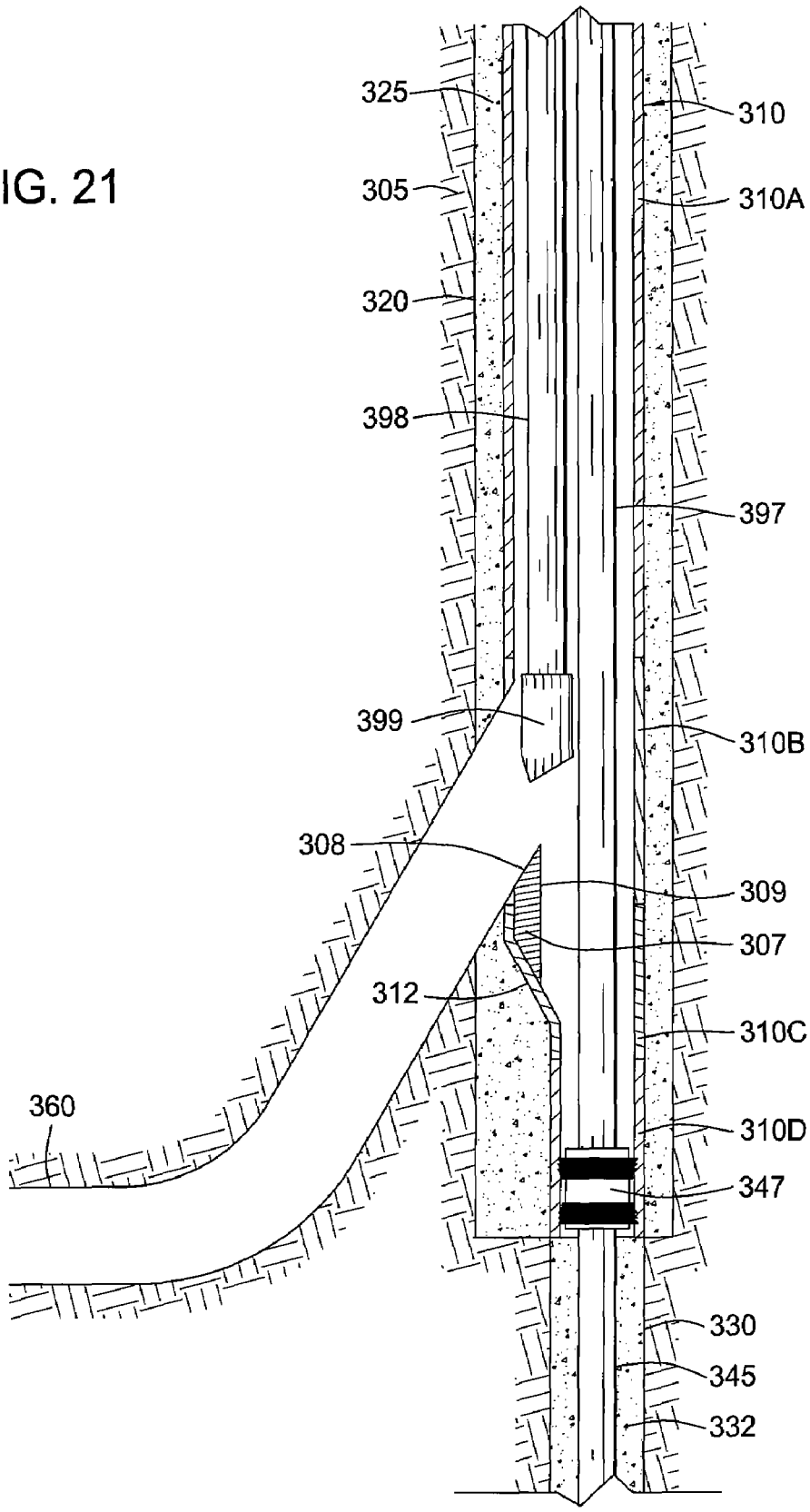
FIG. 21 shows a second casing being lowered into the second wellbore through the surface casing of FIG. 17.

As shown in FIG. 21, tie-back casing 397 need not include a deflector thereon. A second casing 398 may have a lipstick-shaped guide shoe 399 or bent sub operatively connected to its lower end. The lipstick shape of the guide shoe 399 provides an angled surface which is capable of sliding over the angled, deflecting surface 308, so that the guide shoe 399 angled surface and the deflecting surface 308 are capable of guiding the second casing 398 into the second wellbore 360.

In the operation of the third embodiment, first in reference to FIG. 17, the wellbore 320 is formed in the formation 305, preferably by a drill bit on a drill string (not shown). The drill string is removed from the wellbore 320, and the surface casing 310 is lowered into the wellbore 320. Cement 325 may be introduced to at least partially fill the annulus between the outer diameter of the surface casing 310 and the wall of the wellbore 320 and set the surface casing 310 within the wellbore 320. When lowering the surface casing 310 into the wellbore 320, the side of the surface casing 310 having the deflector member 307 attached thereto is located in the direction in which the second wellbore 360 (see FIG. 20) is eventually desired to be formed.

A drill string (not shown) having a drill bit operatively connected to its lower end is then lowered into the inner diameter of the surface casing 310 and guided over the angled portion 312 into the smallest inner diameter portion of the crossover casing portion 310C and the third casing portion 310D (the leg). The drill bit is then used to drill into the formation 305 below the third casing portion 310D to form the first wellbore 330, shown in FIG. 18. The drill string may include one or more logging-while-drilling or measuring-while-drilling tools, or any other steering tools known to those skilled in the art, for altering the trajectory of the first wellbore 330 while drilling.

After drilling the first wellbore 330, the drill string is removed from the first wellbore 330 and from the wellbore 320 to the surface. The first casing 345 is lowered into the inner diameter of the surface casing 310 and into the first wellbore 330. Again, the angled portion 312 of the surface casing 310 guides the first casing 345 into the smallest inner diameter portion of the crossover casing portion 310C, into the third casing portion 310D, and into the first wellbore 330. The first casing 345 may be hung at least temporarily from the inner diameter of the surface casing 310 (as shown in FIG. 18) or from the wall of the first wellbore 330 using the liner hanger 347. Optionally, the first casing 345 may then be set within the first wellbore 330 by at least partially filling the annulus between the first casing 345 and the wall of the first wellbore 330 with cement 332.

Optionally, a plug may be placed in the inner diameter of the first casing 345 at this point in the operation to prevent debris from falling into the first casing 345. The plug may be any mechanism capable of obstructing access from the portion of the inner diameter of the first casing 345 above the plug to the portion of the inner diameter of the first casing 345 below the plug. For example, the plug may be a bridge plug or a plug set in a nipple, as known by those skilled in the art.

Next, the diverting tool 395 is lowered using a running string 355 or other running tool known to those skilled in the art into the inner diameter of the surface casing 310, as shown in FIG. 18. Because of the existence of the extending end 362 of the diverting tool 395, the diverting tool 395 is forced into position in the crossover casing portion 310C. If the diverting tool 395 is in the wrong position for the extending end 362 to enter the crossover casing portion 310C, the running string 355 will not lower to a sufficient depth, so that the running string 355 may be lifted and the diverting tool 395 re-oriented within the surface casing 310. FIG. 18 depicts the diverting tool 395 being lowered into the surface casing 310 and oriented correctly within the crossover casing portion 310C. In its correct orientation within the crossover casing portion 310C, the first side 363 of the diverting tool 395 slides along the side 309 of the deflector member 307.

FIG. 19 shows the diverting tool 395 positioned within the crossover casing portion 310C. Once positioned, the diverting tool 395 is prevented from rotational movement relative to the surface casing 310 for the same reasons as the diverting tool 250 is prevented from rotation relative to the surface casing 210, as described above in relation to FIGS. 9-16. When the diverting tool 395 is seated on the crossover casing portion 310C, the deflecting surfaces 308 and 358 of the deflector member 307 and the diverting tool 395, respectively, form a unified, generally continuous deflecting surface for deflecting one or more tools and/or tubulars into the direction in which the second wellbore 360 is formed. After the diverting tool 395 is seated in the crossover casing portion 310C, the running string 355 is removed from its connection with the diverting tool 395, thereby exposing threads 356 on the upper end of the diverting tool 395 (if the connection between the running string 355 and diverting tool 395 is threaded).

A drill string (not shown, but similar to the drill string 235 shown and described in relation to FIG. 10) having a drill bit (not shown, but similar to the drill bit 240 shown and described in relation to FIG. 10) operatively connected to its lower end is then lowered into the inner diameter of the surface casing 310. The deflecting surface formed by the deflecting surfaces 308 and 358 of the deflector member 307 and the diverting tool 395, respectively, deflects the drill bit into the inner diameter of the side of the surface casing 310 to which the deflector member 307 is attached. The deflecting surface acts as a guide to dictate the direction and orientation of the drill bit when the drill bit is used to form the second wellbore 360.

The drill bit then drills through the second portion 310B of the surface casing 310, which is constructed of a drillable material, preferably fiberglass. The second wellbore 360, shown in FIG. 20, is then formed within the formation 305 from the surface casing 310 using the drill bit. As mentioned above in relation to the first wellbore 330, the drill string may include one or more logging-while-drilling or measuring-while-drilling tools for altering the trajectory of the second wellbore 360. After the second wellbore 360 is formed, the drill string is removed from the second wellbore 360. FIG. 20 shows the second wellbore 360 formed in the formation 305 and the drill bit removed.

Referring again to FIGS. 18 and 19, the running string 355 is lowered into the surface casing 310 to retrieve the diverting mechanism 395. Next, a tie-back casing 397, which is shown in FIG. 20, is lowered into the inner diameter of the surface casing 310, and the lower end of the tie-back casing 397 is operatively connected to the upper end of the first casing 345. The tie-back casing 397 operates to tie the first casing 345 back to the surface and thereby allow communication between the surface and the first wellbore 330 through the first casing 345 and tie-back casing 397. As mentioned above, the tie-back casing 397 is not required to include a deflector thereon for deflecting the second casing 398 (see FIG. 21) into the second wellbore 360, as the deflector member 307 is integral to the surface casing 310 and performs this service.

FIG. 20 shows the tie-back casing 397 operatively connected to the first casing 345 and the second wellbore 360 formed. If the plug is disposed within the first casing 345, the plug may be retrieved at this point in the operation.

Finally, the second casing 398 is lowered into the inner diameter of the surface casing 310, as shown in FIG. 21. The second casing 398 is lowered into the surface casing 310 between the outer diameter of the tie-back casing 397 and the inner diameter of the surface casing 310 on the side of the surface casing 310 from which the second wellbore 360 is formed. The angled lower surface of the guide shoe 399 aids in guiding the second casing 398 to slide along the deflecting surface 308 of the deflector member 307.

Ultimately, the second casing 398 is placed within the second wellbore 360. The second casing 398 may be set within the second wellbore 360 by partially or completely filling the annulus with cement or some other physically alterable bonding material. In lieu of cement, the second casing 398 may be set within the second wellbore 360 by using one or more hanging mechanisms known to those skilled in the art.

The third embodiment shown and described in relation to FIGS. 17-21 allows two independent cased wellbores 360, 330 to be formed downhole from only one cased wellbore 320 visible from the surface. These two wellbores 360, 330 are capable of being formed and completed using only one wellhead without moving the wellhead.

FIG. 22 is a cross-sectional view of the tie-back casing 270 with the deflector 275 thereon. The tie-back casing 270 may include blades 291A, 291B having a first length and blades 292A, 292B having a second length longer than the first length. In a preferred, non-limiting embodiment, the blades 291A, 291B, 292A, 292B are constructed of steel, the first length is approximately 1½ inches, and the second length is in the range of approximately 4½ inches to approximately 5 inches. The blades 291A, 291B, 292A, 292B are preferably spaced apart along the outer diameter of the tie-back casing 270 at approximately 90 degree intervals. These blades 291A, 291B, 292A, 292B are used to position the tie-back casing 270 within the surface casing 210 so that the tie-back casing 270 is located in position above the first casing 245 and a space exists between blades 292A, 292B for inserting a second casing 280. The blades 291A, 291B, 292A, 292B further ensure that the tie-back casing 270 remains radially positioned with respect to the surface casing 210. The blades 292A and 292B include the deflector 275 therebetween, the rounded outer surface of the deflector 275 being generally radially parallel to the inner surface of the surface casing 210. In one embodiment, the deflector 275 is a cut-out portion of a tubular member with the inside concave surface facing upward. FIG. 22 shows the concave surface of the deflector 275 using lines on the deflector 275. The concave surface helps to prevent the second casing 280 from falling from the deflecting surface 287 while it is being manipulated into the second wellbore 260.

Although the surface casing 210, 310 of the above embodiments shown in FIGS. 9-21 is generally described and shown as being constructed of four portions 210A-D, 310A-D, the surface casing 210, 310 may instead by constructed of only one portion having the general shape of the surface casing 210, 310, or may instead be constructed of any number of portions operatively connected to one another. The portions of the surface casing 210, 310 may be formed from the same materials or different materials.

While the foregoing is directed to embodiments of the present invention, other and further embodiments of the invention may be devised without departing from the basic scope thereof, and the scope thereof is determined by the claims that follow.

The invention claimed is:

1. A method for drilling multiple wellbores into an earth formation using one wellhead, comprising:

providing casing extending downhole from a surface of the earth formation;

drilling a first wellbore below the casing; and lowering a template connected to a first casing string to a predetermined depth within the casing, the template having at least two bores therein.

2. The method of claim 1, further comprising drilling a second wellbore below the casing through a second bore of the at least two bores in the template.

3. The method of claim 2, further comprising altering the trajectory of at least one of the first and second wellbores while drilling at least one of the first and second wellbores.

4. The method of claim 2, further comprising lowering a second casing string into the second wellbore through the second bore in the template.

5. The method of claim 2, wherein at least one funnel guides the second casing string into the second wellbore.

6. The method of claim 2, wherein the method is accomplished without moving a blowout preventer in a wellhead.

7. The method of claim 2, further comprising drilling a third wellbore below the casing through a third bore of the at least two bores in the template.

8. The method of claim 2, wherein at least one of the first and second wellbores is deviated from vertical.

9. The method of claim 8, further comprising:

drilling an extended wellbore below the casing prior to drilling the first wellbore below the casing; and deviating at least one of the first and second wellbores from vertical by altering an orientation of a drill string within the extended wellbore, the drill string drilling at least one of the first and second wellbores.

10. The method of claim 2, further comprising plugging the upper end of the first casing string prior to drilling the second wellbore below the casing.

11. The method of claim 10, further comprising;

lowering a second casing string into the second wellbore through the second bore in the template; and connecting the upper end of the first casing string to the surface to provide a fluid path from the surface to within the first wellbore.

12. The method of claim 1, wherein the predetermined depth within the casing comprises a restricted inner diameter portion of the casing capable of preventing the template from further lowering within the casing.

13. The method of claim 1, wherein an anti-rotation device substantially prevents rotation of the template while lowering the template to the predetermined depth.

14. The method of claim 13, wherein the anti-rotation device comprises at least one lug disposed near an outer diameter of the template.

15. A method for drilling multiple wellbores from a single wellhead, comprising:

providing a wellhead at a surface of an earth formation and a casing within the earth formation;

drilling a first wellbore below the casing;

lowering a template having a first casing string located therethrough from the wellhead to a predetermined depth within the casing while locating the first casing string within the first wellbore; and drilling and casing a second wellbore below the casing through the template.

16. The method of claim 15, wherein drilling and casing a second welibore below the casing through the template comprises:

drilling the second wellbore through a first bore disposed in the template; and inserting a second casing string through the first bore and into the second wellbore.

17. The method of claim 16, further comprising:

drilling a third wellbore through a second bore disposed in the template; and inserting a third casing string through the second bore and into the third wellbore without moving the wellhead.

18. The method of claim 16, further comprising extending the first casing string to the surface by connecting a casing string to an upper end of the first casing string.

19. The method of claim 18, further comprising activating a dual hanger connected to a welihead to grippingly engage the casing string connected to the first casing string and the second casing string, wherein activating is accomplished without moving the wellhead.

20. The method of claim 15, wherein casing the first wellbore further comprises:

introducing cement into an annulus between the first casing string and the first wellbore.

21. The method of claim 15, wherein the first and second wellbore are drilled using one or more drill strings.

22. The method of claim 21, wherein one of the one or more drill strings is inserted through a bore in the template to drill the second wellbore.

23. The method of claim 15, wherein at least one of the first and second wellbores is deviated from vertical.

24. The method of claim 15, further comprising altering a trajectory of the first wellbore while drilling the first wellbore.

25. The method of claim 15, further comprising altering a trajectory of the second wellbore while drilling the second wellbore.

26. The method of claim 15, wherein drilling and casing the first wellbore and the second welibore is accomplished without moving the wellhead.

27. A method for drilling at least two wellbores into an earth formation from a casing within a parent wellbore using one wellhead, comprising:

providing the casing extending downhole from a surface of the formation, the casing having a first portion and a second portion, the second portion having a smaller inner diameter than the first portion;

forming a first wellbore in the formation from the second portion; and forming a second wellbore from the first portion by drilling through a circumferential wall of the casing and into the formation.

28. The method of claim 27, further comprising placing a first casing within the first wellbore.

29. The method of claim 28, further comprising positioning a diverting mechanism above the first casing within the casing.

30. The method of claim 29, further comprising forming the second wellbore by lowering a drilling mechanism into the casing and diverting the drilling mechanism into the second wellbore using the diverting mechanism.

31. The method of claim 30, further comprising operatively connecting the first casing to a surface of the wellbore using a tie-back casing.

32. The method of claim 31, wherein the tie-back casing comprises a deflector member operatively connected to its outer surface having a deflecting surface sloping towards the second wellbore.

33. The method of claim 32, further comprising placing a second casing in the second wellbore by lowering the second casing into the casing and moving the second casing over the deflecting surface into the second wellbore.

34. The method of claim 29, further comprising a deflector member extending from the casing wall below a desired location for the second wellbore.

35. The method of claim 34, wherein the deflector member and the diverting mechanism together form a diverting surface.

36. The method of claim 35, further comprising forming the second wellbore by lowering a drilling mechanism into the casing and diverting the drilling mechanism into the second wellbore using the diverting surface.

37. The method of claim 35, wherein the deflector member and the diverting mechanism include mating profiles on outer surfaces thereof for preventing rotation of the deflector member relative to the casing.

38. The method of claim 29, wherein an outer surface of the diverting mechanism and the inner diameter of the casing comprise mating profiles thereon for preventing rotation of the deflector member relative to the casing.

39. The method of claim 29, wherein the diverting mechanism includes an extending end for placement into the second portion to prevent rotation of the diverting mechanism relative to the casing.

40. The method of claim 30, further comprising guiding a first casing into the first wellbore using a guiding portion of the casing, the guiding portion connecting the first portion to the second portion.

41. The method of claim 28, further comprising plugging an inner diameter of the first casing.

42. The method of claim 28, further comprising placing a second casing within the second wellbore.

43. The method of claim 27, wherein the second portion is axially offset from the first portion.

44. The method of claim 27, wherein the first and second wellbores are formed from the same wellhead without moving the wellhead.

45. A method of forming first and second wellbores from a casing using a common wellhead, comprising:

providing the casing in a welibore, the casing comprising:
an upper portion having a first inner diameter;
a lower portion having a second, smaller inner diameter; and
a connecting portion connecting the upper and lower portions, the centerlines of the upper and lower portions offset;

forming the first welibore from the lower portion; and forming the second wellbore into the formation through a wall of the upper portion, using the connecting portion as a guide.

46. The method of claim 45, further comprising placing a first casing within the first wellbore prior to forming the second wellbore.

47. The method of claim 46, further comprising placing a diverting mechanism having a sloped surface on the connecting portion after placing the first casing within the first wellbore.

48. The method of claim 47, further comprising guiding a drilling tool along the sloped surface.

49. The method of claim 48, further comprising drilling through the wall of the upper portion and forming the second wellbore using the drilling tool.

50. The method of claim 49, further comprising tying back the first casing to the surface using tie-back casing.

51. The method of claim 50, wherein the tie-back casing comprises a deflector member operatively connected to its outer surface.

52. The method of claim 51, further comprising guiding a second casing into the second wellbore using the deflector member.

* * * * *